US011825906B2

(12) United States Patent
Gavrieli et al.

(10) Patent No.: US 11,825,906 B2
(45) **Date of Patent: *Nov. 28, 2023**

(54) SPLIT-SOLE FOOTWEAR

(71) Applicant: Gavrieli Brands LLC, Beverly Hills, CA (US)

(72) Inventors: Kfir Gavrieli, Los Angeles, CA (US); Dikla Gavrieli, Los Angeles, CA (US)

(73) Assignee: Gavrieli Brands LLC, Beverly Hills, CA (US)

( * ) Notice: Subject to any disclaimer, the term of this patent is extended or adjusted under 35 U.S.C. 154(b) by 54 days.

This patent is subject to a terminal disclaimer.

(21) Appl. No.: 17/001,360

(22) Filed: Aug. 24, 2020

(65) Prior Publication Data

US 2021/0137210 A1 May 13, 2021

Related U.S. Application Data

(63) Continuation of application No. 15/905,239, filed on Feb. 26, 2018, now abandoned, which is a (Continued)

(51) Int. Cl.
*A43B 3/10* (2006.01)
*A43B 3/24* (2006.01)

(Continued)

(52) U.S. Cl.
CPC ..... *A43B 3/248* (2013.01); *A43B 3/10* (2013.01); *A43B 3/108* (2013.01); *A43B 3/12* (2013.01);

(Continued)

(58) Field of Classification Search
CPC .. A43B 13/28; A43B 5/12; A43B 3/10; A43B 3/101; A43B 3/108; A43B 3/24; A43B 3/248; A43B 13/16

(Continued)

(56) References Cited

U.S. PATENT DOCUMENTS 249,086 A 11/1881 Pienovi
773,850 A 11/1904 Cooper et al.

(Continued)

FOREIGN PATENT DOCUMENTS

CA 2254437 A1 9/1999
CN 2190425 Y 3/1995

(Continued)

OTHER PUBLICATIONS

Diliunas, S., et al. "Distribution of Stress in Variable Rigidity Soft Polymer Constructions", Materials Science, 1(8), pp. 36-39.

(Continued)

*Primary Examiner* — Marie D Bays
(74) *Attorney, Agent, or Firm* — MORGAN, LEWIS & BOCKIUS LLP

(57) ABSTRACT

A shoe comprising an upper forming an interior portion for a foot, the interior portion including toe and heel cavities, is provided. The shoe further comprises a midsole having toe and heel ends and inner and outer sides. The midsole is stitched to the upper thereby forming a bottom to the interior portion. Heel and toe outsole patches are respectively stitched onto the midsole. An insole is affixed to the bottom of the interior portion. A spacing between the heel and toe outsole patches extends from the inner to the outer side and occupies a position intermediate the toe and heel ends thereby permitting the shoe to fold about an axis running through the spacing. The shoe folds between an extended state, in which the shoe is worn, and a folded state in which a portion of the upper comprising the toe cavity is tucked into the heel cavity.

19 Claims, 12 Drawing Sheets

Related U.S. Application Data continuation of application No. 15/204,763, filed on Jul. 7, 2016, now Pat. No. 9,930,925, which is a continuation of application No. 14/266,599, filed on Apr. 30, 2014, now Pat. No. 9,398,786, which is a continuation of application No. 13/207,397, filed on Aug. 10, 2011, now Pat. No. 8,745,893.

(51) Int. Cl.

| | |
|---|---|
| ***A43B 5/12*** | (2006.01) |
| ***A43B 9/02*** | (2006.01) |
| ***A43B 13/12*** | (2006.01) |
| ***A43B 13/16*** | (2006.01) |
| ***A43B 13/14*** | (2006.01) |
| ***A43B 3/12*** | (2006.01) |
| ***A43B 13/18*** | (2006.01) |
| ***A43B 23/02*** | (2006.01) |

(52) U.S. Cl.

CPC ..... *A43B 3/24* (2013.01); *A43B 5/12* (2013.01); *A43B 9/02* (2013.01); *A43B 13/122* (2013.01); *A43B 13/14* (2013.01); *A43B 13/141* (2013.01); *A43B 13/16* (2013.01); *A43B 13/186* (2013.01); *A43B 23/0245* (2013.01)

(58) Field of Classification Search

USPC ..... 36/102, 103, 8.3, 11, 31, 9 R, 12, 18, 21

See application file for complete search history.

(56) References Cited

U.S. PATENT DOCUMENTS

| | | | | |
|---|---|---|---|---|
| 830,941 | A | | 9/1906 | Walden |
| 1,208,209 | A | | 12/1916 | Prince |
| 1,214,666 | A | | 2/1917 | Ford |
| 1,386,651 | A | | 8/1921 | Pageau |
| 1,519,009 | A | | 12/1924 | Reina |
| 1,525,848 | A | | 2/1925 | B. S. |
| 1,587,377 | A | | 6/1926 | Grosjean |
| 1,650,466 | A | | 11/1927 | Righter |
| 1,984,989 | A | | 12/1934 | Reed |
| 2,016,788 | A | | 10/1935 | Naidor |
| 2,224,590 | A | | 12/1940 | Odilon |
| 2,268,777 | A | | 1/1942 | Scholl |
| D133,381 | S | | 8/1942 | Gutfrucht |
| D133,819 | S | | 9/1942 | Harris |
| D135,791 | S | | 6/1943 | Beebe |
| 2,323,563 | A | | 7/1943 | Nugent |
| 2,342,882 | A | | 2/1944 | Meltzer |
| D141,871 | S | | 7/1945 | Braun |
| 2,383,585 | A | | 8/1945 | Bindner |
| 2,438,321 | A | | 3/1948 | Maling |
| D149,685 | S | | 5/1948 | Sandler |
| D150,729 | S | | 8/1948 | Sandler |
| 2,548,961 | A | | 4/1951 | Foster |
| 2,578,091 | A | | 12/1951 | Reed |
| D166,090 | S | | 3/1952 | Maling |
| 2,738,527 | A | | 3/1956 | Weiss |
| 2,772,488 | A | | 12/1956 | Meltzer |
| 2,904,814 | A | | 9/1959 | Scholl |
| 2,926,433 | A | | 3/1960 | Kramer |
| 3,052,046 | A | | 9/1962 | Kramer |
| 3,148,378 | A | | 9/1964 | Tibbitts |
| 3,157,954 | A | | 11/1964 | Cunniff |
| D200,897 | S | | 4/1965 | Mitchell |
| 3,186,013 | A | | 6/1965 | Glassman |
| D220,464 | S | | 4/1971 | Hayashi |
| 4,069,601 | A | | 1/1978 | Robbins |
| D247,396 | S | | 3/1978 | Schlerth |
| 4,224,747 | A | | 9/1980 | Winfield |
| 4,412,393 | A | | 11/1983 | Terlizzi, Jr. et al. |
| D275,525 | S | | 9/1984 | Nakao |
| 4,554,749 | A | | 11/1985 | Ostrander |
| 4,674,206 | A | | 6/1987 | Lyden |
| D295,692 | S | | 5/1988 | Zuidema et al. |
| D300,085 | S | | 3/1989 | Ito et al. |
| RE33,018 | E | | 8/1989 | Ostrander |
| 4,899,412 | A | | 2/1990 | Ganon |
| 4,944,099 | A | | 7/1990 | Davis |
| D316,773 | S | | 5/1991 | Valle |
| 5,012,541 | A | | 5/1991 | Ganon |
| 5,127,170 | A | * | 7/1992 | Messina ..... A43B 23/08 36/105 |
| D339,669 | S | | 9/1993 | Miller |
| 5,282,326 | A | | 2/1994 | Schroer, Jr. et al. |
| 5,421,050 | A | | 6/1995 | Laganas |
| 5,699,629 | A | | 12/1997 | Munschy |
| 5,746,014 | A | | 5/1998 | Tanemoto |
| D420,785 | S | | 2/2000 | Perez |
| 6,055,745 | A | | 5/2000 | Endoh |
| 6,076,284 | A | | 6/2000 | Terlizzi |
| 6,120,038 | A | * | 9/2000 | Dong ..... A43B 5/1633 280/11.33 |
| 6,189,239 | B1 | | 2/2001 | Gasparovic et al. |
| 6,338,207 | B1 | | 1/2002 | Chang |
| D457,292 | S | | 5/2002 | Sessa |
| 6,405,459 | B1 | | 6/2002 | Prevost |
| D461,947 | S | | 8/2002 | Merceron |
| D476,798 | S | | 7/2003 | Reynolds et al. |
| 6,588,124 | B2 | | 7/2003 | Morrone |
| 6,711,835 | B1 | | 3/2004 | Militello |
| D498,041 | S | | 11/2004 | McClaskie |
| D500,191 | S | | 12/2004 | Belley et al. |
| D501,706 | S | | 2/2005 | McClaskie |
| 6,857,203 | B2 | | 2/2005 | Minden |
| 6,895,693 | B2 | | 5/2005 | Baruck |
| 6,978,557 | B2 | | 12/2005 | Lee |
| 7,010,870 | B2 | | 3/2006 | Mick |
| 7,032,327 | B1 | | 4/2006 | Tartaglia et al. |
| 7,036,244 | B1 | | 5/2006 | Finch |
| D527,513 | S | | 9/2006 | Della Valle |
| D529,513 | S | | 10/2006 | Aketa |
| D531,790 | S | | 11/2006 | Wurzburg |
| D534,341 | S | | 1/2007 | Choi |
| D542,513 | S | | 5/2007 | Amado et al. |
| 7,249,426 | B2 | | 7/2007 | Romano |
| D556,990 | S | | 12/2007 | Cabados |
| 7,337,558 | B2 | | 3/2008 | Terlizzi et al. |
| D567,485 | S | | 4/2008 | James |
| D570,488 | S | | 6/2008 | Kirksey et al. |
| D571,084 | S | | 6/2008 | Comeau |
| D571,548 | S | | 6/2008 | Seamans |
| D571,989 | S | | 7/2008 | Siegal |
| D580,640 | S | | 11/2008 | Wurzburg |
| D582,638 | S | | 12/2008 | Ringholz |
| 7,496,982 | B2 | | 3/2009 | Clark et al. |
| 7,506,459 | B2 | | 3/2009 | Grisoni et al. |
| D591,031 | S | | 4/2009 | Cofinco |
| D593,295 | S | | 6/2009 | Belley et al. |
| D593,297 | S | | 6/2009 | Belley et al. |
| D593,307 | S | | 6/2009 | Belley et al. |
| D599,093 | S | | 9/2009 | Issler |
| D604,030 | S | | 11/2009 | Wilson |
| D607,194 | S | | 1/2010 | Zagula |
| D610,332 | S | | 2/2010 | Raichle |
| D610,785 | S | | 3/2010 | Smith |
| D611,693 | S | | 3/2010 | Schwartz |
| D612,140 | S | | 3/2010 | Moon |
| D612,141 | S | | 3/2010 | Moon |
| 7,694,435 | B1 | | 4/2010 | Kiser et al. |
| 7,694,437 | B2 | | 4/2010 | Hogan |
| D615,737 | S | | 5/2010 | Feller |
| 7,735,244 | B1 | | 6/2010 | Ameche |
| 7,743,530 | B2 | | 6/2010 | Truelsen |
| D618,891 | S | | 7/2010 | McClaskie |
| 7,757,408 | B2 | | 7/2010 | McClaskie |
| D630,829 | S | | 1/2011 | Weisner |
| D632,881 | S | | 2/2011 | Rosenberg |
| 7,926,203 | B2 | | 4/2011 | Wilkenfeld |
| 7,966,747 | B2 | | 6/2011 | Wilkenfeld et al. |
| D640,861 | S | | 7/2011 | Wilkenfeld |

(56) References Cited

U.S. PATENT DOCUMENTS

| | | | | |
|---|---|---|---|---|
| 8,020,320 | B2 | 9/2011 | Gillespie | |
| 8,127,468 | B2 | 3/2012 | Morgan | |
| D657,543 | S | 4/2012 | Bove | |
| D659,960 | S | 5/2012 | Bizzo | |
| 8,230,619 | B2 | 7/2012 | Salvatelli | |
| D664,755 | S | 8/2012 | Gavrieli et al. | |
| D665,157 | S | 8/2012 | Wu | |
| 8,240,067 | B2 | 8/2012 | Sussmann | |
| 8,245,420 | B2 | 8/2012 | Wilson | |
| D668,027 | S | 10/2012 | Millieret | |
| D668,438 | S | 10/2012 | Millieret | |
| D668,847 | S | 10/2012 | Gavrieli et al. | |
| D668,848 | S | 10/2012 | Gavrieli et al. | |
| D668,849 | S | 10/2012 | Pozzi | |
| D668,850 | S | 10/2012 | Pozzi | |
| D672,542 | S | 12/2012 | Gray et al. | |
| 8,333,024 | B2 | 12/2012 | Fallow | |
| D676,634 | S | 2/2013 | Gavrieli et al. | |
| D681,927 | S | 5/2013 | Gavrieli | |
| D681,928 | S | 5/2013 | Gavrieli | |
| D681,929 | S | 5/2013 | Gavrieli | |
| D683,936 | S | 6/2013 | Gavrieli | |
| 8,468,723 | B2 | 6/2013 | Malka-Harari | |
| 8,510,975 | B2 | 8/2013 | Krikelis | |
| D688,853 | S | 9/2013 | Gavrieli | |
| D688,854 | S | 9/2013 | Gavrieli | |
| D688,855 | S | 9/2013 | Gavrieli | |
| D689,270 | S | 9/2013 | Gavrieli | |
| D689,271 | S | 9/2013 | Gavrieli | |
| D689,272 | S | 9/2013 | Gavrieli | |
| D690,914 | S | 10/2013 | Gavrieli | |
| D690,915 | S | 10/2013 | Gavrieli | |
| D696,500 | S | 12/2013 | Hunt | |
| D699,424 | S | 2/2014 | Hamm | |
| 8,661,714 | B2 | 3/2014 | Sussman | |
| 8,745,893 | B2 | 6/2014 | Gavrieli | |
| 8,973,287 | B2 | 3/2015 | Shibata | |
| 9,398,786 | B2 * | 7/2016 | Gavrieli | A43B 13/186 |
| D781,032 | S | 3/2017 | Gavrieli | |
| D781,033 | S | 3/2017 | Gavrieli | |
| D781,034 | S | 3/2017 | Gavrieli | |
| D781,035 | S | 3/2017 | Gavrieli | |
| D782,167 | S | 3/2017 | Gavrieli | |
| 9,930,925 | B2 * | 4/2018 | Gavrieli | A43B 13/141 |
| D831,312 | S | 10/2018 | Gavrieli | |
| 2001/0005947 | A1 | 7/2001 | Sordi | |
| 2002/0014020 | A1 | 2/2002 | Ellis, III | |
| 2002/0078591 | A1 | 6/2002 | Morrone | |
| 2002/0129519 | A1 | 9/2002 | Cahan | |
| 2002/0178614 | A1 | 12/2002 | Issler | |
| 2003/0029055 | A1 | 2/2003 | Morrone | |
| 2003/0070319 | A1 | 4/2003 | Minden | |
| 2003/0121176 | A1 | 7/2003 | Baruck | |
| 2004/0025377 | A1 | 2/2004 | Brannon | |
| 2005/0022421 | A1 | 2/2005 | Bruckner | |
| 2005/0091883 | A1 * | 5/2005 | Davis | A43B 13/141 36/76 R |
| 2005/0115115 | A1 | 6/2005 | Lacey | |
| 2005/0217148 | A1 | 10/2005 | Connolly et al. | |
| 2005/0262734 | A1 | 12/2005 | Cheng | |
| 2006/0086005 | A1 | 4/2006 | Yerian | |
| 2006/0130363 | A1 * | 6/2006 | Hottinger | A43B 13/125 36/11.5 |
| 2006/0156576 | A1 | 7/2006 | Sloan | |
| 2006/0288611 | A1 | 12/2006 | Hogan | |
| 2007/0062064 | A1 | 3/2007 | McClaski | |
| 2007/0074424 | A1 | 4/2007 | Lin | |
| 2007/0204482 | A1 | 9/2007 | Gibson-Collinson | |
| 2007/0204483 | A1 | 9/2007 | Kirsch et al. | |
| 2007/0240331 | A1 * | 10/2007 | Borel | A43B 13/026 36/28 |
| 2008/0052964 | A1 | 3/2008 | Taylor | |
| 2008/0086912 | A1 | 4/2008 | Wilkenfeld | |
| 2008/0110059 | A1 | 5/2008 | Kuramoto et al. | |
| 2008/0196277 | A1 * | 8/2008 | Cook | A43B 1/0036 36/137 |
| 2008/0222915 | A1 * | 9/2008 | Viar | A43B 3/108 36/4 |
| 2009/0019732 | A1 | 1/2009 | Sussmann | |
| 2009/0172971 | A1 | 7/2009 | Peikert | |
| 2009/0193685 | A1 | 8/2009 | Wilson | |
| 2009/0205222 | A1 | 8/2009 | Mclinden | |
| 2009/0272009 | A1 | 11/2009 | Weisner et al. | |
| 2010/0011625 | A1 | 1/2010 | Percival | |
| 2010/0018080 | A1 | 1/2010 | Smith | |
| 2010/0050469 | A1 | 3/2010 | Chen | |
| 2010/0095554 | A1 | 4/2010 | Gillespie | |
| 2010/0095557 | A1 | 4/2010 | Jarvis | |
| 2010/0115793 | A1 | 5/2010 | Kraisosky | |
| 2010/0122475 | A1 | 5/2010 | Purrington | |
| 2010/0139119 | A1 | 6/2010 | Sokolowski | |
| 2010/0146822 | A1 | 6/2010 | MacGregor | |
| 2010/0180466 | A1 | 7/2010 | Ho | |
| 2010/0212186 | A1 | 8/2010 | Cheng | |
| 2010/0275462 | A1 | 11/2010 | Pucci | |
| 2010/0281713 | A1 | 11/2010 | Pantazes | |
| 2011/0088288 | A1 * | 4/2011 | Park | A43B 13/04 12/146 B |
| 2011/0167675 | A1 * | 7/2011 | Matalon | A43B 13/26 36/112 |
| 2011/0214312 | A1 | 9/2011 | Krikelis | |
| 2015/0089843 | A1 | 4/2015 | Gavrieli | |

FOREIGN PATENT DOCUMENTS

| | | | |
|---|---|---|---|
| CN | 2309733 | Y | 3/1999 |
| CN | 2817518 | Y | 9/2006 |
| CN | 101365354 | A | 2/2009 |
| CN | 201216215 | Y | 4/2009 |
| CN | 101594795 | A | 12/2009 |
| CN | 201365610 | Y | 12/2009 |
| CN | 101912175 | A | 12/2010 |
| DE | 20 2006 000230 | U1 | 5/2007 |
| EP | 1 654 944 | B1 | 11/2005 |
| EP | 2 316 294 | A1 | 5/2011 |
| GB | 2443937 | A | 5/2008 |
| GB | 2 446 205 | A | 8/2008 |
| JP | S42-016036 | U | 9/1967 |
| JP | S 5066353 | A | 6/1975 |
| JP | S 5990503 | A | 5/1984 |
| JP | 60-153203 | U | 10/1985 |
| JP | S 62286402 | A | 12/1987 |
| JP | H 0541404 | U | 6/1993 |
| JP | 3011970 | U | 3/1995 |
| JP | 07163401 | A | 6/1995 |
| JP | H 08168404 | A | 7/1996 |
| JP | 8-214908 | A | 8/1996 |
| JP | 3038246 | U | 3/1997 |
| JP | 10-155502 | A | 6/1998 |
| JP | 3072414 | U | 7/2000 |
| JP | S 35-24651 | U | 5/2004 |
| JP | S 38-013106 | U | 8/2006 |
| JP | 2011-83432 | A | 4/2011 |
| KR | 19980033731 | U | 9/1998 |
| KR | 100781008 | B1 | 11/2007 |
| KR | 100805349 | B1 | 2/2008 |
| KR | 20090113473 | A | 11/2009 |
| RU | 72825 | U1 | 10/2008 |
| RU | 89338 | U1 | 12/2009 |
| TW | M251483 | | 1/1993 |
| TW | D119165 | | 10/2007 |
| UA | 86 029 | C2 | 3/2009 |
| WO | WO 85/05540 | | 12/1985 |
| WO | WO 2008/093035 | A1 | 8/2008 |
| WO | WO 2011/005568 | A2 | 1/2011 |

OTHER PUBLICATIONS

Ryan, John C., et al. "The Story of a Shoe", Life Cycles, World Watch, Mar./Apr. 1998, pp. 29-32.

(56) References Cited

OTHER PUBLICATIONS

Walker, JT, et al. "Mortality of workers employed in shoe manufacturing", Scandinavian Journal of Work, Environment & Health, May 1993, vol. 19, No. 2, pp. 89-95.
Examination Report for AU 341324, , 3 pgs., dated Oct. 24, 2012.
Letter from TMI and Associates with Office Action, 2 pgs, dated Sep. 19, 2012 http://www.payless.com/store/?&TLC=Womens&SLC=WomensNewArrivals&BLC=WomensNewArrivalsNewArrivals&With+Regular&ItemCode=60131&LotNumber=062642&Type=Adult&Popularity=637&Descriptvein .
Taiwanese Office Action for TW 101300726, 10 pgs., dated Sep. 6, 2012.
"The Love List, Tieks by Gavrieli—Foldable Ballet Flats," http://thelovelist-carly.blogspot.com.au/2010/09/tieks-by-gavrieli-foldable-ballet.html, 3 pgs., Sep. 12, 2010.
"Tieks by Gavrieli," http://tieks.com, 1 pg., retrieved Mar. 13, 2013 from URL.
"Try It Mummy!, Tieks by Gavrieli," http://tryitmummy.blogspot.com.au/2010/12/tieks-by-gavrieli.html, 4 pgs., Dec. 9, 2010.
"Wearability—Real People Style, What came first, the City Flat or the Tieks," http://wearability.posterous.com/what-came-first-the-city-flat-or-the-tieks, 4 pgs., Aug. 29, 2010.
"The Ballet Flat . . . Reinvented; Ballet Flats . . . with a Bonus; Step Into Tieks; Going Places? Take Tieks," http://web.archive.org/web/2010052004346/http://www.tieks.com/; 4 pgs., May 24, 2010.
"Tieks—Comfortable designer flats you can fit in your purse and wear all day, every day," http://web.archive.org/web/20110731151555/http://tieks.com/; 6 pgs., Jul. 31, 2011.
"58th Annual Emmy Awards," http://spoonsforksandfashion.blogspot.com/2006_08_01_archive.html, depicting Nine West flats, 11 pgs., Aug. 1, 2006.
Pictures of Nine West flats sold in 2006, 3 pgs.
"I Love a Good Ballet Flat!," http://dressupfiles.com/i-love-a-good-ballet-flat, depicting Sue London flats, 4 pgs., Sep. 3, 2010.
Pictures of Sue London flats sold in 2010, 2 pgs.
"Miss Cathie Reviews: The Yosi Samra Foldable Ballet Flat . . . ," http://www.misscathie.com/2010/01/miss-cathie-reviews-the-yosi-samra-foldable-ballet-flat/,depicting Yosi Samra flats, 7 pgs., Jan. 2010.
Pictures of Yosi Samra flats sold in 2010, 2 pgs.
"Goodbye two thousand ten," http://emmajoyrussell.blogspot.com/2010_12_01_archive.html, depicting Gap flats, 39 pgs., Dec. 1, 2010.
Pictures of Gap flats available for sale in 2010, 9 pgs.
"Our newest design of folding flats-Pink," https://fitinclouds.wordpress.com/2010/05/16/our-newest-design-of-folding-flats-pink/, depicting Fit in Clouds flats, 1 pg., May 16, 2010.
"Fit in Clouds Satin Folding Shoes," http://www.goodhousekeeping.com/product-reviews/clothing/best-ballet-flats/fit-in-clouds-satin-foldable-ballet-flats, depicting Fit in Clouds flats, 1 pg., Aug. 2013.
Pictures of Fit in Clouds flats available for sale in 2011, 4 pgs.
"Shoes for Standing," https://truthinshoes.wordpress.com/2008/07/, depicting Sam & Libby flats, 2 pgs., Jul. 31, 2008.
"Target Designer Collaboration: Announcing Sam & Libby Shoes for Target," http://www.therecessionista.com/2012/11/target-designer-collaboration-announcing-sam-libby-shoes-for-target.html, depicting Sam & Libby flats, 1 pg., Nov. 26, 2012.
Pictures of Sam & Libby flats available for purchase in 2011, 5 pgs.
"Save your soles with Citisoles ballet flats," http://glamazondiaries.com/2009/07/save-your-soles-with-citisoles-ballet-flats, depicting Citisoles flats, 3 pgs., Jul. 2009.
Pictures of Citisoles flats available for purchase in 2009, 3 pgs.
"#16 Corso Como Delicious Pumps Review and Giveaway!," http://www.mommatoldmeblog.com/2011/01/16-corso-como-delicious-pumps-review.html, depicting Corso Como flats, 8 pgs., Jan. 16, 2011.
Pictures of Corso Como flats available for sale in 2011, 3 pgs.
"Jil-sander-navy-lead-ballet-flats-product . . . ," www.ebay.com, depicting Jil Sander flats, 4 pgs., Nov. 2013.
Pictures of Jil Sander flats available for sale in 2011, 3 pgs.
"Spare Soles: Shoes That Roll-up & Fold-up," http://herpackinglist.com/2011/01/spare-soles-shoes/, depicting Spare Soles flats, 2 pgs., Jan. 2011.
Pictures of Spare Soles flats available for sale in 2011, 5 pgs.
The Original Rollable, Foldable ballet flats with matching wristlet—Spare Soles, http://herpackinglist.com/2011/01/spare-soles-shoes/, depicting Roll-Upz Spare Soles flats, 2 pgs., Jan. 2011.
Pictures of Roll-Upz by Spare Soles flats available for sale in 2011, 6 pgs.
"The Cutest Blog, Preppy 50 and Loving Lilly, Ballet Flat Delight," http://preppy50andlovinglilly.blogspot.com/2011/02/ballet-flat-delight.html, depicting Henri Bendel flats, 13 pgs., Feb. 19, 2011.
Pictures of Henri Bendel flats available for sale in 2011, 4 pgs.
"Mumsnet by parents for parents," http://www.mumsnet.com/Talk/style_and_beauty/a1612000-Anyone-tried-Redfoot-Flatmates-foldable-ballet-pumps, depicting Redfoot Flatmates flats, 1 pg, Nov. 14, 2012.
Pictures of Redfoot Flatmates flats available for sale in 2011, 6 pgs.
"Amazon.com: Customer Reviews: Bloch London Women's Lux Ballet Flat," http://www.amazon.com/Bloch-London-Womens-Ballet-Flat/product-reviews/B004LWP7YW, depicting Bloch London flats, 4 pgs., Dec. 11, 2011.
Pictures of Bloch London flats offered for sale in 2011, 11 pgs.
"H&m foldable leopard print flat," http://845shops.wordpress.com/2011/06/16/flats-for-7-bucks/shoel/, depicting h&m flats, 3 pgs., Jun. 16, 2011.
Pictures of h&m foldable flats offered for sale in 2011, 4 pgs.
"Seekyt—Juicy Couture Ballet Flats—Are They Worth The Money?," http://seckyt.com/juicy-couture-ballet-flats-are-they-worth-the-money/, 14 pgs., Jun. 3, 2011.
Pictures of Juicy Couture flats offered for sale in 2011, 3 pgs.
"Purse Flats," http://purseflats.wordpress.com, depicting Purse Flats by Erica Wilson, 3 pgs., Jul. 12, 2012.
Pictures of Purse Flats by Erica Wilson offered for sale in 2011, 6 pgs.
"Splash Page," http://web.archive.org/web/20100524004346/http://www.tieks.com/, 4 pgs., May 24, 2010.
"Tieks by Gavrieli—Comfortable, designer flats you can fit in your purse and wear all day . . . ," http://web.archive.org/web/20110202210649/http://www.tieks.com/, 8 pgs., Feb. 2, 2011.
"Carolina M. M. Goncalez > Tieks by Gavrieli," http://m2.facebook.com/Tieks?y=timeline&filter=2&timecutoff=1406427986&page=17&sectionLoadingID=m_timeline_loading_div_1293868799_1262332800_8_17&timeend=1293868799&timestart=1262332800&tm=AQDOvqhWQPN_Nbwm&refid=17, 1 pg. Jan. 26, 2010.
"The Shoes Oprah Would Wear to Work (if She Had to Walk)," http://www.inc.com/30under30/christina-desmarais/kfir-gavrieli-and-elram-gavrieli-founders-of-tieks.html, 8 pgs., Jul. 2, 2012.
"Tieks by Gavrieli," http://m2.facebook.com/Tieks?v=timeline&filter=2&timecutoff=1406427986&page=14&sectionLoadingID=m_timeline_loading_div_1293868799_1262332800_8_14&timeend=1293868799&timestart=1262332800&tm=AQDOvqhWQPN_Nbwm&refid=17, 4 pgs., Jan. 26, 2010.
"Mighty Life List, Sensible Shoes," http://mightygirl.com/2010/08/24/sensible-shoes/, 10 pgs., Aug. 24, 2010.
"Find! Tieks: Fab & sexy flats for fall," http://thefabmom.com/2013/08/29/find-tieks-fab-sexy-flats-for-fall/, 3 pgs. Aug. 29, 2013.
"Step into Tieks," http://sliceofpink.typepad.com/blog/2010/09/tieks-1.html, 5 pgs., Sep. 22, 2010.
"In Need of Flat-Soled Shoes," http://sliceofpink.typepad.com/blog/2010/09/tieks-1.html, 7 pgs., Oct. 3, 2010.
File_22_8.jpg, 1, Publication date unknown (publicly accessible on May 16, 2010), Gavrieli Brands LLC, http://www.tieks.com/media/catalog/product/f/i/file_22_8.jpg.
File_23_7.jpg, 1, Publication date unknown (publicly accessible on May 16, 2010), Gavrieli Brands LLC, http://www.tieks.com/media/catalog/product/f/i/file_23_7.jpg.
File_24_7.jpg, 1, Publication date unknown (publicly accessible on May 16, 2010), Gavrieli Brands LLC, http://www.tieks.com/media/catalog/product/f/i/file_24_7.jpg.
File_21_9.jpg, 1, Publication date unknown (publicly accessible on May 16, 2010), Gavrieli Brands LLC, http://www.tieks.com/media/catalog/product/f/i/file_21_9.jpg.

(56) References Cited

OTHER PUBLICATIONS

File_5_4.jpg, 1, Publication date unknown (publicly accessible on May 16, 2010), Gavrieli Brands LLC, http://www.tieks.com/media/catalog/product/f/i/file_5_4.jpg.
File_13_6.jpg, 1, Publication date unknown (publicly accessible on May 16, 2010), Gavrieli Brands LLC, http://www.tieks.com/media/catalog/product/f/i/file_13_6.jpg.
Take Tieks, 1-3, Jan. 22, 2010, sliceofpink, https://sliceofpi n k.typepad.com/blog/2010/01/ta ke-tieks.html.
Third Party Submission Under 37 CFR 1.290 regarding U.S. Appl. No. 15/905,239, filed Feb. 9, 2019, 94 pages.
Order Granting TRO (D.I. 11), *Gavrieli Brands LLC* vs. *Soto Massini*, Civil Action No. 1:18-cv-00462, Mar. 28, 2018, 2 pages.
Defendants' Opposition To Motion For Temporary Restraining Order, Civil Action No. 1:18-cv-00462-GMS, Apr. 1, 2018, 12 pages.
Declaration of Thomas Pichler In Opposition To Tro Request, C.A. No. 1:18-cv-00462-GMS, Apr. 1, 2018, 8 pages.
Exhibit A to Pichler Declaration ISO TRO Opposition (D.I. 13-1), C.A. No. 1:18-cv-00462-GMS, Apr. 1, 2018, 29 pages.
Order TRO (D.I. 18), C.A. No. 1:18, Apr. 4, 2018, 3 pages.
Defendant *Soto Massini* (*USA*) *Corporation*'s Answer and Counterclaims To Verified Complaint for Patent Infringement, Trade Dress Infringement, and Unfair Competition, C.A. No. 1:18-cv-00462-GMS, May 1, 2018, 26 pages.
Defendant *Soto Massini* (*USA*) *Corporation*'s Answer To Amended Complaint and Amended Counterclaims, C.A. No. 1:18-cv-00462-GMS, Jun. 5, 2018, 28 pages.
Defendant *Soto Massini* (*USA*) *Corporation*'s Answer To Amended Complaint and First Amended Counterclaims, C.A. No. 1:18-cv-00462-GMS, Jul. 12, 2018, 31 pages.
Exhibit A to SACC (45-1), Case 1:18-cv-00462-GMS, 3 pages.
Exhibit B to SACC (45-2), Case 1:18-cv-00462-GMS, 5 pages.
Exhibit C to SACC (45-3), Case 1:18-cv-00462-GMS, 5 pages.
Exhibit D to SACC (45-4), Case 1:18-cv-00462-GMS, 4 pages.
Defendant *Soto-USA*'s Invalidity Contentions, C.A. No. 1:18-cv-00462-MN, 16 pages.
Redacted Verdict Form (D.I. 144), Case 1:18-cv-00462-GMS, 13 pages.
Judgement (D.I. 149), C.A. No. 18-462-MN, May 13, 2019, 3 pages.
*Gavrieli Brands, LLC,* v. *Soto Massini* (*USA*) *Corp., et al.,* (full) Trial Transcript, C.A. No. 18-462(MN), vol. 1, 733 pages.
Expert Report of Caroline de Baere (Fed. R. Civ. P. 26(a)(2)(B), Case No. 18-cv-00462-MN, Mar. 1, 2019, 33 pages.
Exhibit 23, Infringement Analysis in Light of the Alleged Prior Art, 41 pages.
Expert Report of Lance Rake, (Fed. R. Civ. P. 26(a)(2)(B), Mar. 1, 2019, 27 pages.
Camper Book Excerpt—Nina Right, (pp. 334-335), The Walking Society, Lars Müller Publishers, 3 pages.
Camper History—The Shoes, Every Season We Strive To Reinvent Some Of Our Classic Concepts While Continuing To Challenge The Status Quo With New And Original Designs. We Often Find That There Is A Camper Style For Every Walk Of Life, 8 pages.
Tieks by Gavrieli—Comfortable, designer flats you can fit in your purse and wear all day, every day!, Copperhead Snake Print Tieks, https://web.archive.org/web/20101230062534/http://www.tieks.com:80/, Dec. 30, 2010, 1 page.
Tieks by Gavrieli—Comfortable, designer flats you can fit in your purse and wear all day, every day!, Merlot Lizard Print Tieks, https://web.archive.org/web/20101230062534/http://www.tieks.com:80/, Dec. 30, 2010, 1 page.
Tieks by Gavrieli—Comfortable, designer flats you can fit in your purse and wear all day, every day!, Slate Grey Tieks, https://web.archive.org/web/20101230062534/http://www.tieks.com:80/, Dec. 30, 2010, 1 page.
Tieks by Gavrieli—Comfortable, designer flats you can fit in your purse and wear all day, every day!, Camel, https://web.archive.org/web/20101230062534/http://www.tieks.com:80/, Dec. 30, 2010, 1 page.
Tieks by Gavrieli—Comfortable, designer flats you can fit in your purse and wear all day, every day!, Lilac, https://web.archive.org/web/20101230062534/http://www.tieks.com:8, Dec. 30, 2010, 1 page.
Tieks by Gavrieli—Comfortable, designer flats you can fit in your purse and wear all day, every day!, Leopard Print, https://web.archive.org/web/20101230062534/http://www.tieks.com:80/, Dec. 30, 2010, 1 page.
Tieks by Gavrieli—Comfortable, designer flats you can fit in your purse and wear all day, every day!, The Tieks eGift card . . . Always the perfect fit, https://web.archive.org/web/20101230062534/http://www.tieks.com:80/, Dec. 30, 2010, 1 page.
Tieks by Gavrieli—Comfortable, designer flats you can fit in your purse and wear all day, every day!, Copperhead Snake Print, https://web.archive.org/web/20110222174850/http://www.tieks.com:80/, Feb. 22, 2011, 1 page.
Tieks by Gavrieli—Comfortable, designer flats you can fit in your purse and wear all day, every day!, Patent Tiek Blue, https://web.archive.org/web/20110222174850/http://www.tieks.com:80/, Feb. 22, 2011, 1 page.
Tieks by Gavrieli—Comfortable, designer flats you can fit in your purse and wear all day, every day!, Tangerine, https://web.archive.org/web/20110222174850/http://www.tieks.com:80/, Feb. 22, 2011, 1 page.
Tieks by Gavrieli—Fashionable Flats That Fit in Your Purse California Navy, https://web.archive.org/web/20100516173039/http://www.tieks.com:80/california-navy.html, May 16, 2010, 1 page.
Tieks by Gavrieli—Fashionable Flats That Fit in Your Purse Cardinal Red, https://web.archive.org/web/20100516173045/http://www.tieks.com:80/cardinal-red.html, May 16, 2010, 1 page.
Tieks by Gavrieli—Fashionable Flats That Fit in Your Purse Metallic Gold, https://web.archive.org/web/20100516173106/tieks.com/metallic-gold.html, May 16, 2010, 1 page.
Tieks by Gavrieli—Fashionable Flats That Fit in Your Purse Patent Tiek Blue, https://web.archive.org/web/20100516173130/http://www.tieks.com:80/tiek-blue.html, May 16, 2010, 1 page.
Tieks by Gavrieli—Fashionable Flats That Fit in Your Purse Splash Page, The Ballet Flat . . . Reinvented, https://web.archive.org/web/20100513055818/https://tieks.com/, May 13, 2010, 1 page.
Tieks by Gavrieli—Fashionable Flats That Fit in Your Purse Splash Page, Ballet Flats . . . with a Bonus, https://web.archive.org/web/20100513055818/https://tieks.com/, May 13, 2010, 1 page.
Tieks by Gavrieli—Fashionable Flats That Fit in Your Purse Splash Page, Going Places? Take Tieks. https://web.archive.org/web/20100513055818/https://tieks.com/, May 13, 2010, 1 page.
Tieks by Gavrieli—Fashionable Flats That Fit in Your Purse Splash Page, Step Into Tieks, https://web.archive.org/web/20100513055818/https://tieks.com/, May 13, 2010, 1 page.
Tieks by Gavrieli—Fashionable Flats That Fit in Your Purse True Blue, https://web.archive.org/web/20100516173135/http://www.tieks.com:80/true-blue.html, May 16, 2010, 1 page.
Tieks by Gavrieli—Fashionable Flats That Fit in Your Purse White Croc Print, https://web.archive.org/web/20100516173145/http://www.tieks.com:80/white-croc-print.html, May 16, 2010, 1 page.
Tieks by Gavrieli—Foldable Fashionable Ballet Flats, Wild Copper, Be a little wild . . . even when you're not., https://web.archive.org/web/20100819165503/https://tieks.com/, Aug. 19, 2010, 1 page.
Tieks by Gavrieli—Foldable Fashionable Ballet Flats, Paradise Blue, The perfect pair for day and night, https://web.archive.org/web/20100819163503/https://tieks.com/, Aug. 19, 2010, 1 page.
Tieks by Gavrieli—Foldable Fashionable Ballet Flats, Obsidian Black, When workdays spill over into party nights., https://web.archive.org/web/20100819165503/https://tieks.com/, Aug. 19, 2010, 1 page.
Tieks by Gavrieli—Foldable Fashionable Ballet Flats, Fuchsia, Sweet and sultry, https://web.archive.org/web/20100819165503/https://tieks.com/, Aug. 19, 2010, 1 page.

(56) References Cited

OTHER PUBLICATIONS

Tieks by Gavrieli—Foldable Fashionable Ballet Flats, Tan Croc print Tieks, A timeless texture., https://web.archive.org/web/20100819165503/https://tieks.com/, Aug. 19, 2010, 1 page.
Tieks by Gavrieli—Foldable Fashionable Ballet Flats, Be a little wild . . . even when you're not., https://web.archive.org/web/20100902020755/https://tieks.com/, Sep. 2, 2010, 1 page.
Tieks by Gavrieli—Foldable Fashionable Ballet Flats, Obsidian Black, When workdays spill over into party nights. https://web.archive.org/web/20100902020755/https://tieks.com/, Sep. 2, 2010, 1 page.
Tieks by Gavrieli—Foldable Fashionable Ballet Flats, Tan Croc Print, A timeless texture, https://web.archive.org/web/20100902020755/https://tieks.com/, Sep. 2, 2010, 1 page.
Tieks by Gavrieli—Foldable Fashionable Ballet Flats, Paradise Blue, The perfect pair for day and night, https://web.archive.org/web/20100902020755/https://tieks.com/, Sep. 2, 2010, 1 page.
Tieks by Gavrieli—Foldable Fashionable Ballet Flats, Fuchsia, Sweet and sultry, https://web.archive.org/web/20100902020755/https://tieks.com/, Sep. 2, 2010, 1 page.
Tieks by Gavrieli—Foldable Fashionable Ballet Flats, Tiek Blue Tieks, Let yourself shine, https://web.archive.org/web/20100902020755/https://tieks.com/, Sep. 2, 2010, 1 page.
"The 25 Most Innovative Consumer And Retail Brands," https://www.forbes.com/sites/ryancaldbeck/2013/07/30/25-of-the-most-creative-consumer-and-retail-brands/, 39 pgs., Jul. 30, 2013.
"Top 30 Startups to Watch 2013," https://www.entrepreneur.com/growing-a-business/top-30-startups-to-watch/228244, 34 pgs., Sep. 10, 2013.
"Dressing for the Journey: These top performers will get travelers from Point A to Point Z," 1 pg., May 12, 2013.
"The Best; Comfy design flats are worth the cost," 2 pgs., Sep. 7, 2013.

* cited by examiner

SPLIT-SOLE FOOTWEAR

CROSS-REFERENCE TO RELATED APPLICATION

This application is a continuation of U.S. patent application Ser. No. 15/905,239, filed Feb. 26, 2018, which is a continuation of U.S. patent application Ser. No. 15/204,763, filed Jul. 7, 2016, now U.S. Pat. No. 9,930,925, which is a continuation of U.S. patent application Ser. No. 14/266,599, filed Apr. 30, 2014, now U.S. Pat. No. 9,398,786, which is a continuation of U.S. patent application Ser. No. 13/207,397, filed Aug. 10, 2011, now U.S. Pat. No. 8,745,893, the contents of which is incorporated by reference in its entirety for all purposes.

FIELD OF THE DISCLOSURE

The present disclosure relates to footwear and more specifically, split-sole shoes.

BACKGROUND

Conventional footwear has structural limitations that force the wearer to make difficult choices between style and comfort. As a result, many individuals endure significant foot pain, or elect to wear less attractive shoes or styles that may not be appropriate for the occasion. To address this problem, some women carry additional footwear in a car or large bag. However, a spare pair of conventional shoes is less than ideal because of size and bulk limitations on portability. Lightweight rollable or foldable shoes are available that offer increased portability. However, such products do not contain the support, durability, comfort or style desired in a non-foldable shoe.

Moreover, prior art foldable shoes have outsoles that do not adequately protect the shoe midsole and upper, leading to premature wear of the shoe including tearing and damage to the shoe. Furthermore, such shoes are typically flimsy or, in other words, do not provide adequate support or protection of the foot. For instance, many foldable shoes have an overall spring constant that is, depending on the brand and model, between 0.14 kilogram-force/inch and 0.34 kilogram-force/inch. Such shoes provide little or no resistance, protection and support, and thus are inadequate to wear for repeated or extended use, particularly outside or on rough terrain (e.g., dirty pavement, stones, etc.). Moreover, such shoes are not durable enough to last a normal shoe lifespan even with only moderate use. Therefore, while some footwear designs have attempted to bridge the gap between full time and portable shoes, there remains no practical solution.

In prior art shoe manufacturing processes, outsoles are sewn onto a midsole. These outsoles are at the bottom of the shoe and protect the midsole and upper from wear and tear and further provide support and rigidity to the entire shoe. After the outsoles have been sewn on, the midsole is sewn to the upper and an insole thereby forming a single seam. This single seam traverses the perimeter of the shoe and essentially delineates the shoe upper from the midsole. While such processes are advantageous because of manufacturing efficiencies, the drawback with such approaches is realized when one considers the properties of the outsoles. The sewing wheel of the sewing machine used to sew the midsole, the upper, and the insole together interferes with the outsoles previously sewn onto the midsole. As a result, a dilemma arises. The ideal outsole patches serve to 1) protect the foot, 2) provide comfort, and 3) provide durability by protecting the seam attaching the midsole, outsole and insole. Thus, the ideal outsole patches are thick and wide such that the perimeter of the outsoles is close to the seam. Yet, as the outsole becomes thicker and is brought closer to the seam that attaches the upper, midsole and insole, the seam becomes more difficult and eventually impossible to stitch. Thus, prior art shoes are constructed with either (i) thin and wide or (ii) narrow and thick outsole patches. Moreover, prior art shoes are limited on their ability to add cushion inserts below the insole because such cushion inserts make the seam even less manageable and force more narrowing and thinning of the outsole patches leading to greater instability and/or lower durability of the shoe and protection of the foot. Thus, in prior art shoes, shoe comfort and durability is traded off for shoe stability. Thus the dilemma become apparent. If the outsole is made thick and narrow, the lack of support due to the gap between the perimeter of the outsoles and the seam becomes noticeable and uncomfortable and the seam, upper and midsole are left exposed to the ground. If the outsole is made thin and wide, the lack of support due to the gap between the perimeter of the outsole and the seam is not as noticeable. However, in such instances, the upper, midsole and seam are exposed to the ground, the outsole wears more quickly and the shoe provides limited protection and comfort.

Given the above background, what is needed in the art are improved foldable shoe designs and improved shoe manufacturing processes.

SUMMARY

The present disclosure addresses the preceding and other shortcomings of the prior art by providing an improved foldable shoe. The disclosed shoes are a split-sole class of women's shoe that allows for the shoe to be folded and placed in a drawstring pouch. The split sole is defined by a heel outsole patch and a toe outsole patch with a spacing between the patches. Advantageously, the disclosed shoes combine an upper and a midsole at a seam with an insole added in separately. Thus, the insole is not concurrently stitched into the seam that joins the midsole to the upper. This allows for (i) the perimeter of the heel outsole patch and the toe outsole patch to be much closer to the seam joining the midsole to the upper, and (ii) the outsole patches to be thicker, thereby affording better protection of the seam, midsole, and upper, greater support and comfort to the foot, a more rigid footbed, and allows for the insertion of thicker more substantial cushioning.

In some embodiments, the outsole patches are sewn on. In some embodiments, the outsole patches are both sewn and glued on. To facilitate sewing the patches on, deep grooves near the perimeter of each outsole patch are afforded. These deep grooves are used to form the seam between the patches and the midsole. The thread used to form this seam is better protected by the deep grooves thereby improving the durability of the shoe and preventing wear on the seam.

The disclosed shoes have an improved spring constant relative to known shoes in the women's split sole class. In some embodiments, the spring constant of the overall shoe is between 0.40 kilogram-force/inch and 0.70 kilogram-force/inch or between 0.55 kilogram-force/inch and 0.65 kilogram-force/inch. This improved spring force constant lends greater support and allows for prolonged periods of wear.

In some embodiments, in addition to providing a foam inlay that is often found in women's shoes, the disclosed shoes allow for the insertion of a cushion insert in the heel portion of the shoes to provide additional support and comfort. Moreover, this heel portion has greater thickness at the heel end of the shoe than at a position intermediate the heel and toe ends of the shoes. Such a tapered thickness provides additional comfort, support, and style.

While it is known to place an elastic restriction at the edge of the upper that receives a woman's foot, the disclosed shoes provide an improved design by terminating the elastic restriction in the heel portion of the shoe. There, rather than using the elastic restriction, an embedded cushion (Achilles' cushion) is provided in order to provide greater comfort.

DETAILED DESCRIPTION

FIGS. 1 through 5 respectively provide perspective, side, top, front and back views of a shoe in accordance with the disclosure. From the perspective and side views of FIGS. 1 and 2, and when worn, the shoe appears no different from a conventional rigid sole shoe. Yet the shoe affords flexibility in design, foldability, and comfort without dressing down the wearer's outfit. In some embodiments, a cushion insert absorbs impact to the foot from walking on hard surfaces. An elastic restriction 60 runs around the top of the upper 2 to grip the foot and form a snug fit on feet of various sizes and shapes. However, the elastic restriction 60 is designed to not encircle the entire foot, by stopping short in the back where it would otherwise uncomfortably grip the Achilles tendon area. Instead, an Achilles cushion 56 is embedded in the upper fold that would otherwise surround the elastic restriction 60 to increase comfort.

Figure 6:
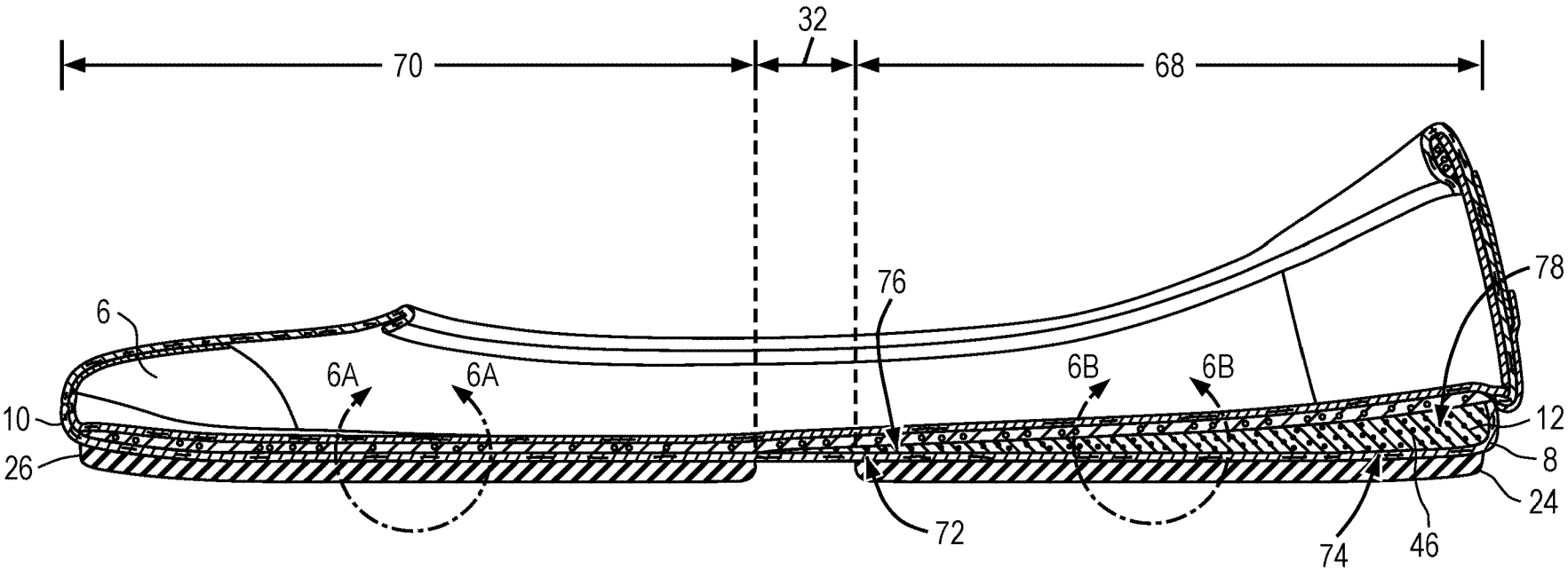
FIG. 6 is a cross-sectional side view of a shoe in accordance with an aspect of the disclosure in which the shoe is in an extended state.

Referring to FIG. 6, a flexible insole 30 provides added comfort without compromising portability, and may be fixed or removable. Optionally, the flexible insole 30 provides arch support. The shoe further comprises a foam inlay 44 that is affixed by glue to the insole 30. In some embodiments, a flexible arch support provides added comfort without compromising portability. The flexible arch support does not restrict folding of the shoe, and may be fixed or removable.

Continuing to refer to FIG. 6, the shoe comprises three uniquely shaped elements: a midsole 8, a heel outsole patch 24, and a toe outsole patch 26. In some embodiments, the midsole 8 is made of a flexible but durable material, such as high quality leather. In some embodiments, the heel outsole patch 24 and toe outsole patch 26 are constructed from all weather, non-skid material. In typical embodiments, the heel outsole patch 24 and the toe outsole patch 26 are individually sewn to the midsole 8. Materials required for the necessary durability and safety of a full time shoe are too rigid to afford the necessary flexibility to be folded. Thus, in preferred embodiments, the heel outsole patch 24 and the toe outsole patch 26 are distinct, and individually stitched to the midsole 8 with a spacing 32 between them for the shoe to be folded. The size and shape of the heel outsole patch 24 and the toe outsole patch 26 are designed to optimally balance durability, comfort, and practicality, with compact size and minimal weight. The shape of the heel outsole patch 24 and the toe outsole patch 26 maximize protection for the foot in a space efficient manner. In some embodiments, the contours of the heel outsole patch 24 and the toe outsole patch 26 are sloped to provide attractive additional height when worn, and increase the clearance between the midsole 8 and the ground when worn. In such embodiments, the slope is designed so that when two shoes are stacked, large meets small so as to significantly reduce the combined thickness of the compressed pair for increased portability.

The upper 2 of the shoe is made of a high quality flexible but durable material designed to withstand repeated folding at the center of the shoe, as well as long periods of storage in the folded position. Such materials reduce or eliminate cracking at the surface of the joint, and damage from contact with surfaces. The upper 2 is constructed and stitched in a manner to wrap around the top and sides of the foot. The specific proportion of upper to outsole also allows the soft upper 2 to mold to wide and narrow feet, molding to the unique shape of each wearer's foot, and adding comfort and style benefits. The proportion also reduces the bulk of the shoes in the folded state for storage and portability. A rounded toe cavity 6 and flexible wraparound upper design increases commercial appeal by reducing or eliminating the need for costly half-size and/or variable width inventory, while maintaining a durable and comfortable design. The design allows great flexibility for fashionable elements via the upper such as distinctive colors, textures and ornamentation. When worn, the shoe appears no different from conventional fixed sole footwear, adding style and the ability to be worn with more formal attire.

Figure 12:
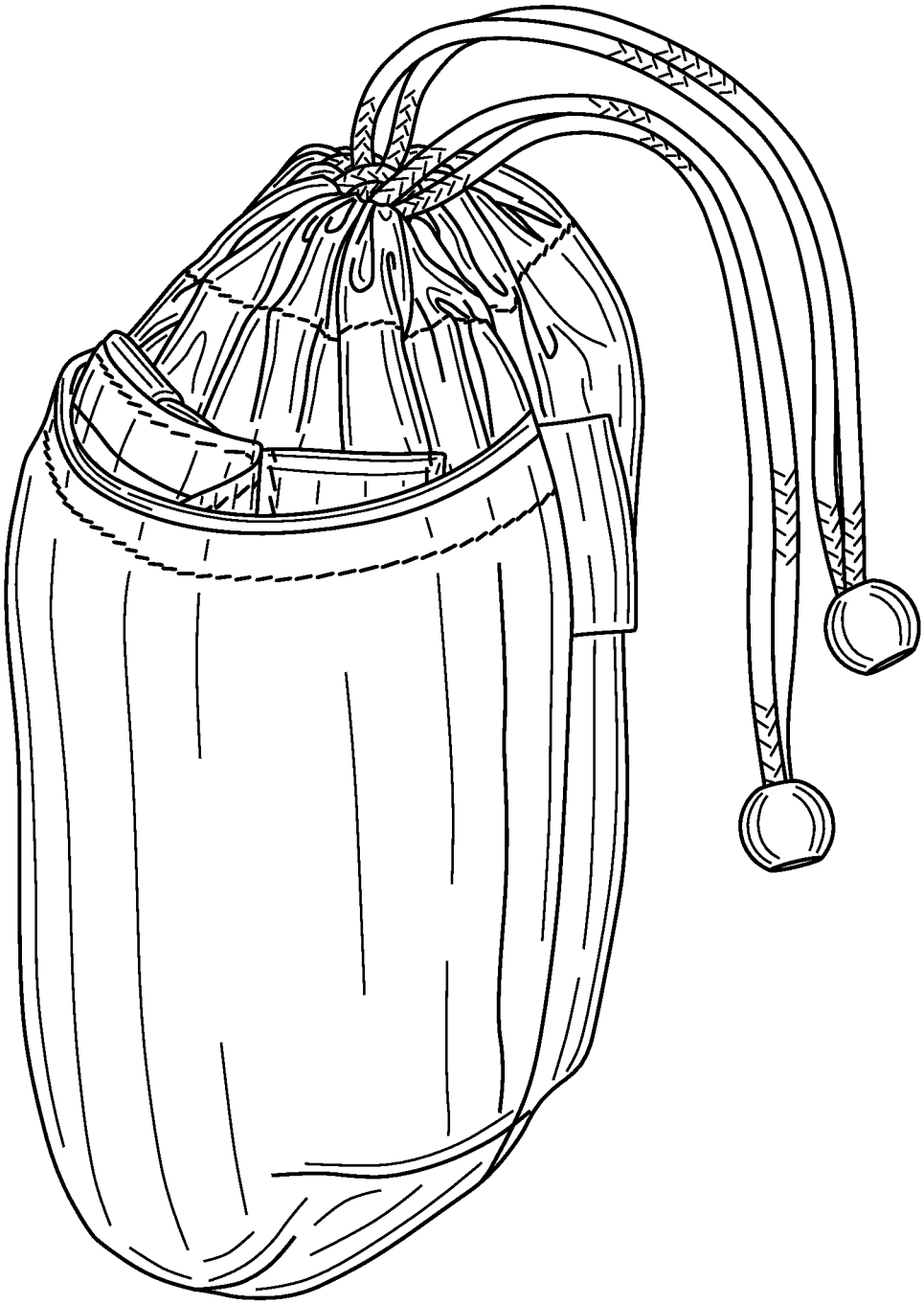
FIG. 12 is a perspective view of a drawstring pouch that may be used to store the shoes of the present disclosure.
Figure 13:
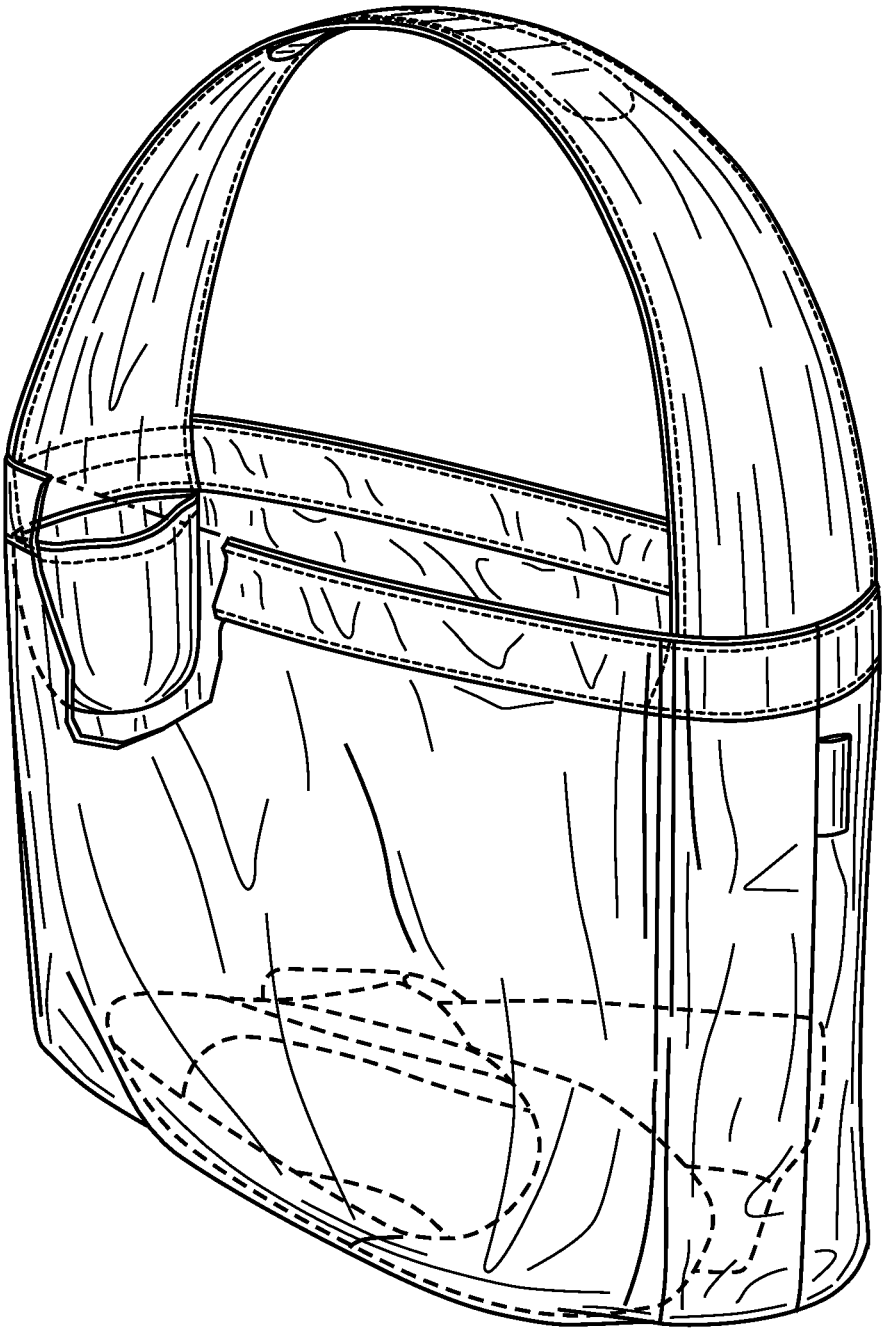
FIG. 13 is a perspective view of a tote bag that may be used to store shoes and other items in accordance with the present disclosure Like reference numerals refer to corresponding parts throughout the several views of the drawings.

Referring to FIG. 13, a lightweight, durable, reusable, self-contained collapsible tote bag with handles that may be folded and compressed, and then stored in the compacting pouch (FIG. 12) adds utility to the foldable shoe system. In typical embodiments pouch is made out of a two-way stretch material and is capable of self-folding into a shape that minimizes volume (e.g., an approximately spherical shape). In some embodiments, the stitching of the pouch facilitates this stretching (e.g., using a zigzag stitching). In some embodiments, a stretch thread material is used in such stitching.

Advantageously, the tote bag may be collapsed into a pocket of the tote bag. In some embodiments, this pocket is in the interior of the tote bag when the tote bag is in the unfolded state. In some embodiments the pocket is made out of an elastic material so that the tote bag is compressed when in the folded state. When desired, the tote expands to carry an alternate pair of shoes with sufficient volume for additional items. In some embodiments this pocket is made out of a two-way stretch material and is capable of self-folding into a shape that minimizes volume (e.g., an approximately spherical shape).

Referring to FIG. 12, a pouch made of stretch nylon, polyester or similar material adds functionality by safely and cleanly storing the foldable footwear and related items. The pouch compresses the footwear in their folded configuration for minimal size when stored or transported. A rounded edge on the bottom of the pouch further decreases volume and increases compression. The pouch is sized just smaller than the footwear to minimize bulk. A drawstring around the opening of the pouch further aids compression, and seals dirty shoes from purse or pocket contents. A pocket located on one side of the pouch allows for compressed storage of the tote bag and/or other items.

The disclosed foldable shoe design allows for footwear to be worn in a normal manner, consistent with conventional rigid sole products, and suitable for various surfaces, weather, fashions, etc. When storage or portability is desired, the shoes are folded manually at approximately their midpoint, thus reducing their length in half. In their folded configuration, the shoes can be stacked and placed in the compacting pouch for maximum compression and portability. Once stowed in the pouch, the pair requires roughly the space of a wallet, and may be carried in a purse or pocket.

Figure 7:
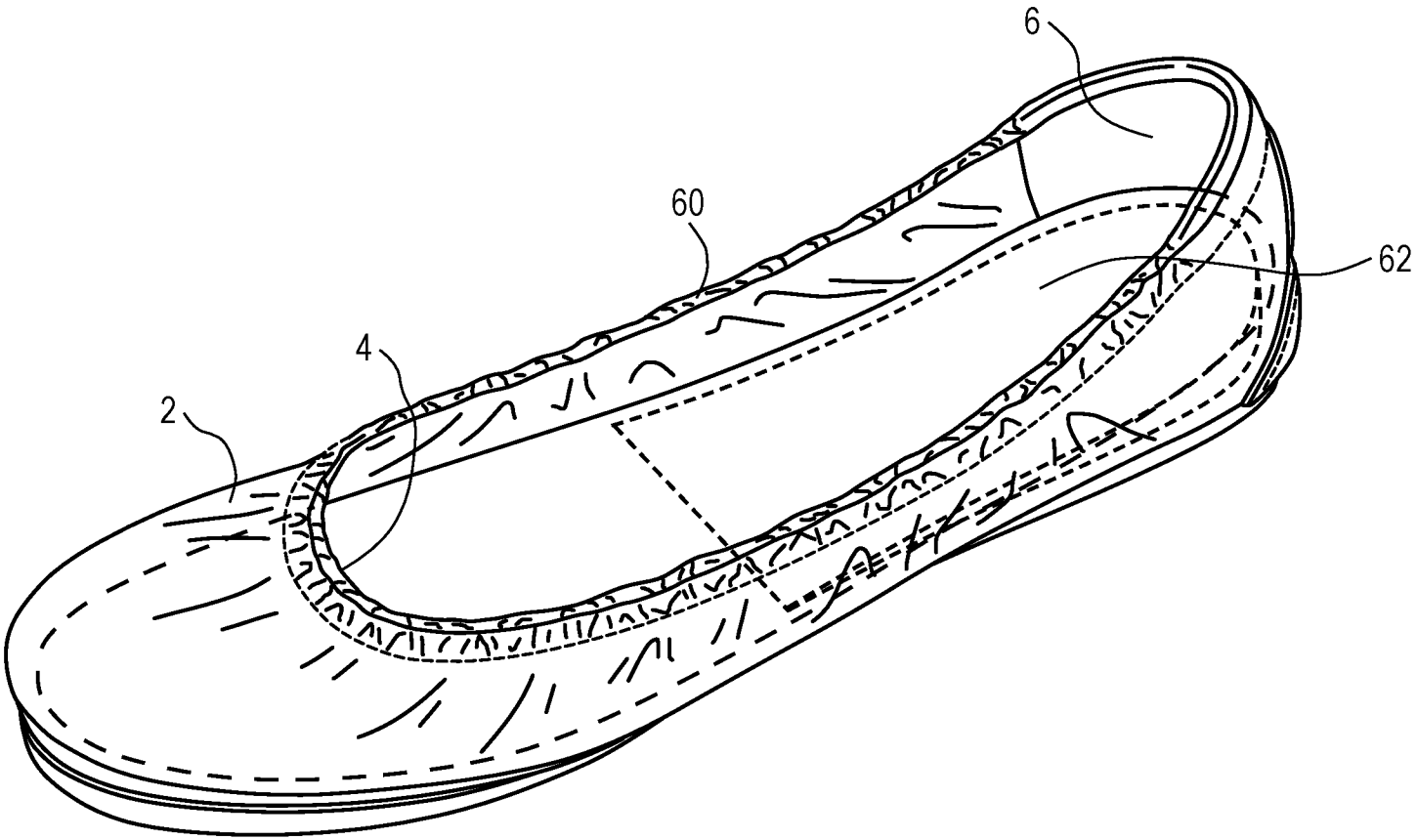
FIG. 7 is a perspective view of a shoe in accordance with an aspect of the disclosure showing a cushion insert in which the shoe is in an extended state.
Figure 8:
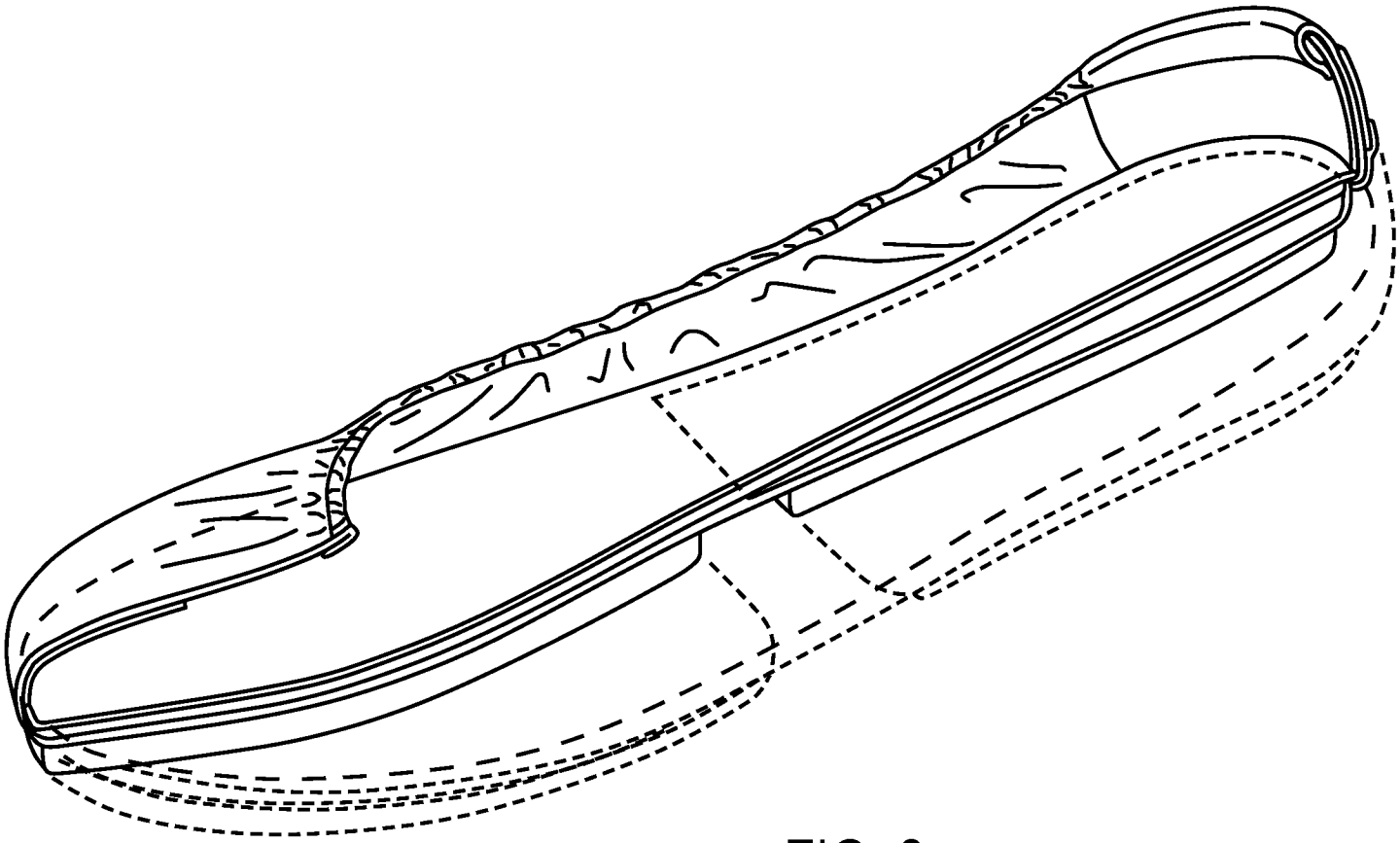
FIG. 8 is a cutaway perspective view of a shoe in accordance with an aspect of the disclosure in which the shoe is in an extended state.

Now that an overview of the inventive shoe has been disclosed, specific features and various embodiments of the disclosed shoes will now be described. Referring to FIG. 7, illustrated is a shoe in accordance with the present disclosure. The shoe comprises an upper 2. The upper 2 forms an interior portion 62 for receiving a foot of a woman. The interior portion includes a toe cavity 4 and a heel cavity 6.

Figure 9:
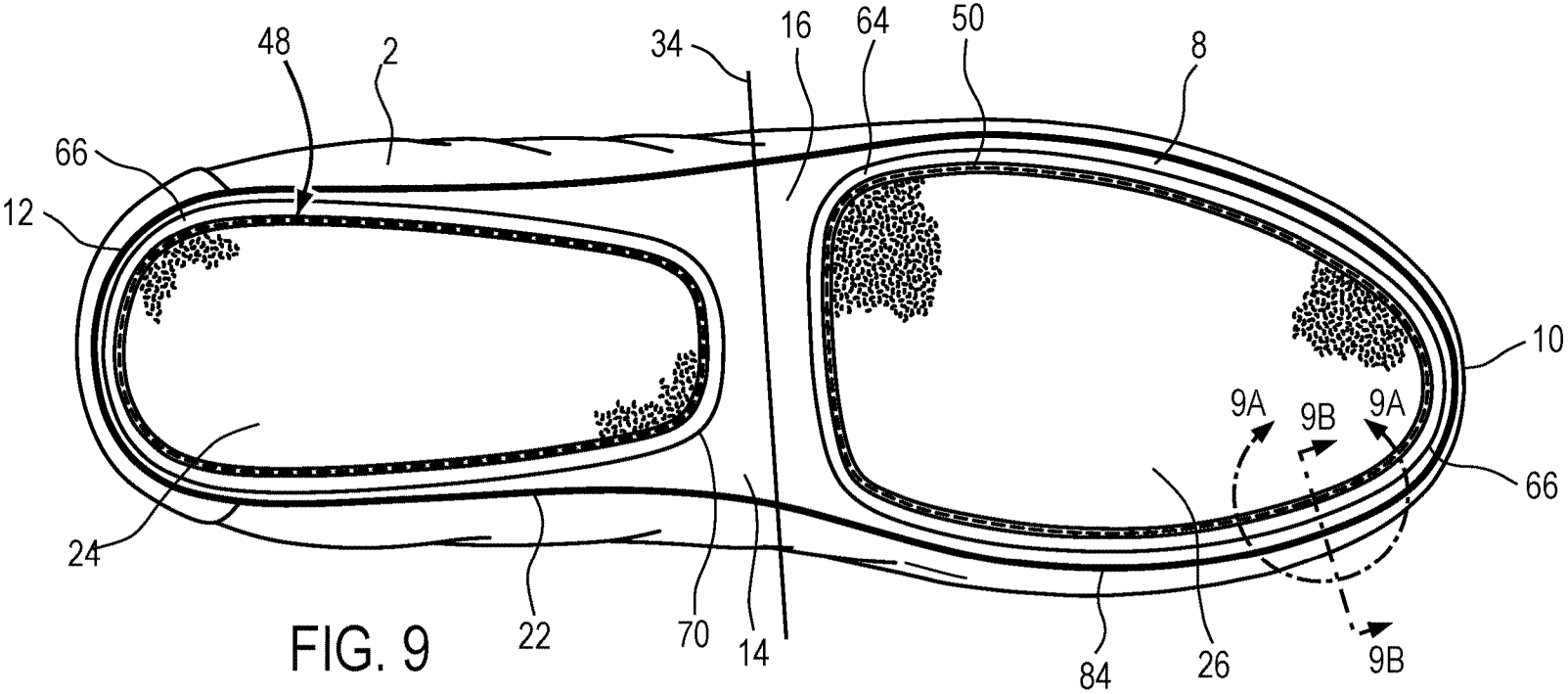
FIG. 9 is a bottom view of a shoe in accordance with an aspect of the disclosure in which the shoe is in an extended state.
Figure 9B:
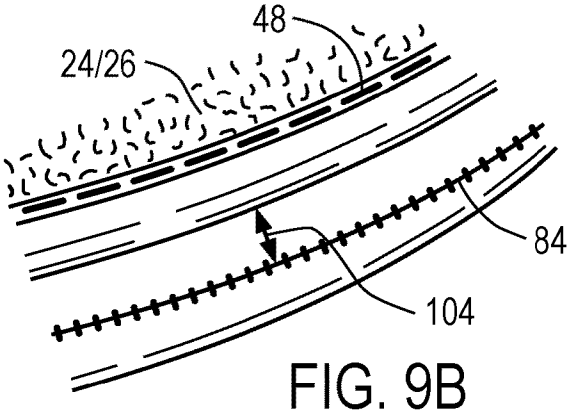
FIG. 9B is an inset cross-sectional view of FIG. 9B, taken about line 9B-9B of FIG. 9.

Referring to FIG. 9, the shoe further comprises a midsole 8. The midsole 8 has (i) a toe end 10, (ii) a heel end 12, (iii) an inner side 14 and (iv) an outer side 16. A perimeter of the midsole 8 is stitched to the upper 2. The stitching of the midsole 8 to the upper 2 thereby forms a bottom to the interior portion 62 that is bounded by a first seam 22. A heel outsole patch 24 is stitched onto a heel portion of a first face of the midsole 8. A toe outsole patch 26 is stitched onto a toe portion of the first face of the midsole 8.

In typical embodiments, the heel outsole patch 24 and the toe outsole patch 26 are stitched onto the midsole before the midsole 8 has been stitched to the upper 2.

Referring to FIG. 6, there is a spacing 32 between (i) the heel outsole patch 24 stitched onto the heel portion of the first face of the midsole 8 and (ii) the toe outsole patch 26 stitched onto the toe portion of the first face of the midsole 8. The spacing 32 extends from the inner side 14 to the outer side 16 of the midsole 8 and occupies a position intermediate the toe end 10 and the heel end 12 of the midsole 8 thereby permitting the entire shoe to fold about an axis 34 in the spacing 32 running between the inner side 14 and the outer side 16. In some embodiments, the spacing is between ⅜ of an inch and ⅝ of an inch. In some embodiments, the spacing is about ⅝ of an inch. In taking these measurements, an "average" distance between the heel outsole patch 24 and the toe outsole patch 26 across the region bounded by the inner side 14 and the outer side 16 may be taken. For example, at several different points in the region bounded by the inner side 14 to the outer side 16, the distance between the edge of the heel outsole patch 24 and the edge of the toe outsole patch 26 may be measured and these measurements may be averaged together to determine the distance between the heel outsole patch 24 and the toe outsole patch 26. In some embodiments the spacing is simply a break between the heel outsole patch 24 and the toe outsole patch 26.

Continuing to refer to FIG. 6, the insole 30 is affixed by glue to the bottom of the interior portion.

Figure 11:
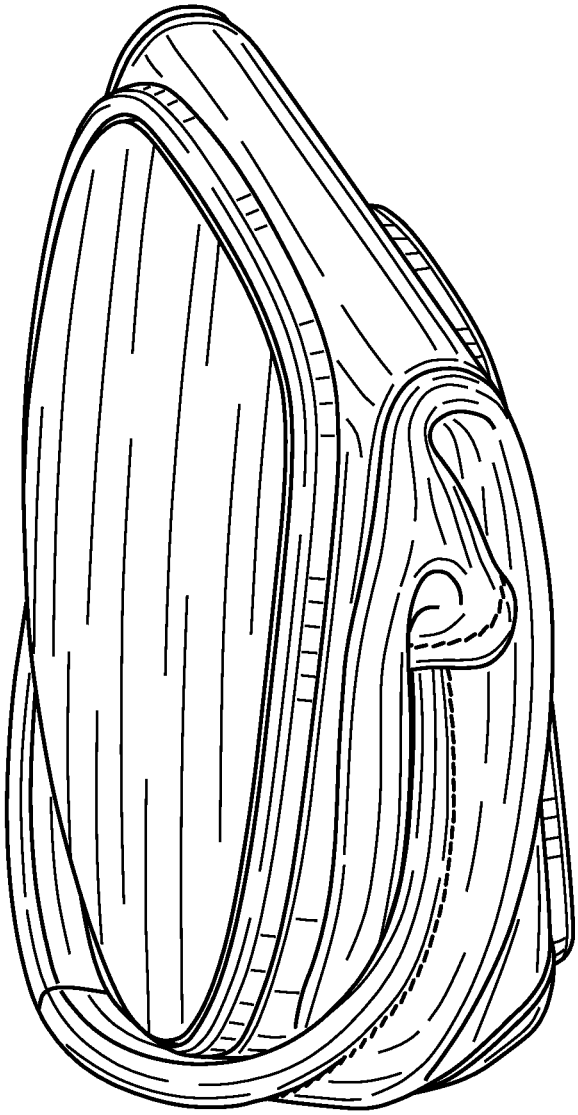
FIG. 11 is a perspective of a shoe in accordance with an aspect of the disclosure in which the shoe is in a folded state in which the shoe is bent about an axis such that a portion of an upper comprising a toe cavity is tucked into a heel cavity.

The shoe is configured to fold between (i) an extended state wherein the heel outsole patch 24 and the toe outsole patch 26 are coplanar (FIGS. 1 through 9) and (ii) a folded state in which the shoe is bent about the axis 34 such that a portion of the upper 2 comprising the toe cavity 4 is tucked into the heel cavity 6 (FIG. 11).

In some embodiments, the insole 30 is not stitched to the upper 2. Thus, in such embodiments, the first seam 22, illustrated in FIG. 9, only joins the upper 2 and the midsole 8, not the insole 30. Referring to FIG. 9, this affords a substantial advantage because it allows a perimeter (edge) of the heel and toe outsole patches 24, 26 to be brought closer to the first seam 22 than in instances where the first seam binds the upper 2, midsole 8 and the insole 30 together, and allows for thicker heel and toe outsole patches, and more substantial (thicker, and more rigid) cushioning in the insole. This distance is illustrated as distance 104 in FIG. 9A. Accordingly, in embodiments where the first seam 22 only joins the upper 2 and the midsole 8, the edge of the back corner 64 of the toe outsole patch 26 is within ¼ of an inch of a portion of the first seam 22. This proximity to the seam 22, along with the thickness of the outsole patches, advantageously serves to protect the first seam 22 as well as the region of the midsole 8 in the spacing 32 from wear and tear. In some embodiments, an edge of front corner 66 of the toe outsole patch 26 is within ¼ of an inch of a portion of the first seam 22.

In typical embodiments, the distance 104 between the edge of the toe outsole pouch 26 and the first seam 22 is uniform. In some embodiments in which this distance 104 is uniform, (i) the edge of the back corner 64 and (ii) the edge of the front corner 66 of the toe outsole patch 26 are respectively within ⅜ of an inch, ⅜ of an inch, or ⅜ of an inch of a corresponding portion of the first seam 22.

In some embodiments, an edge of the back corner 68 of the heel outsole patch 24 is within 3/16 of an inch of a portion of the first seam 22. In some embodiments, an edge of the front corner 70 of the heel outsole patch 24 is between ¾ of an inch and ¾ of an inch of a portion of the first seam 22.

In some embodiments, the distance 104 between the edge of the heel outsole pouch 24 and the first seam 22 is uniform. In some embodiments in which this distance 104 is uniform, (i) the edge of the back corner 68 and (ii) the edge of the front corner 70 of the heel outsole patch 24 are respectively within ⅝ of an inch, ⅜ of an inch, or ⅜ of an inch of a corresponding portion of the first seam 22. In some embodiments, the distance 104 between the edge of the heel outsole pouch 24 and the first seam 22 is not uniform. In some embodiments in which this distance 104 is not uniform, the edge of the back corner 68 of the heel outsole patch 26 is within ⅜ of an inch, or ⅜ of an inch of a corresponding portion of the first seam 22.

Such proximate distances 104, combined with the thickness of the rubber and rigidity of the cushioning enabled by the described method of assembly, facilitate the protection of the midsole 8 and the upper 2, thus ensuring the durability of the shoe while at the same time allowing for a foldable design that remains flexible and comfortable.

Figure 9A:
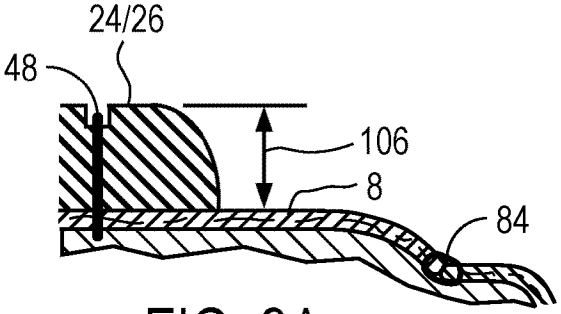
FIG. 9A is an inset perspective view taken about line 9A-9A of FIG. 9.

Referring to FIG. 9A, a unique and improved feature of the present shoes is the value of a durability coefficient. As used herein, the term "durability coefficient" is defined as the thickness 106 of an outsole patch divided by the distance 104 between the edge of the outsole patch and the first seam 22. In some embodiments, the distance 104 is 4 mm and the thickness 106 is also 4 mm and thus the durability coefficient is unity. In some embodiments, the distance 104 is 4 mm and the thickness 106 is 5 mm and thus the durability coefficient is 1.25. In some embodiments, the durability coefficient is between 0.8 and 1.5. In some embodiments, the durability coefficient is between 0.9 and 1.4. In some embodiments, the durability coefficient is between 1.0 and 1.3.

Figure 1:
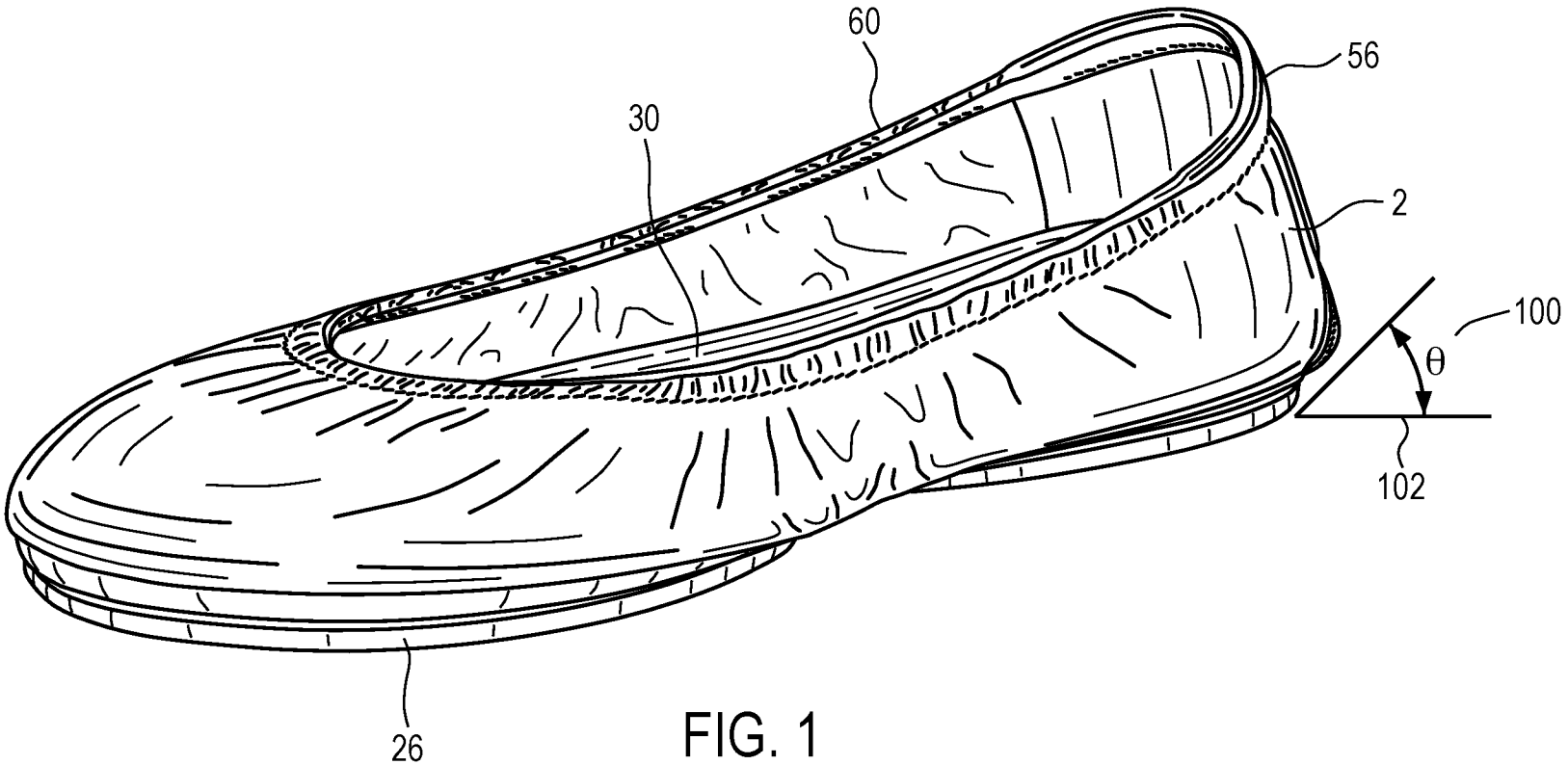
FIG. 1 is a perspective view of a shoe in accordance with an aspect of the disclosure in which the shoe is in an extended state.
Figure 2:
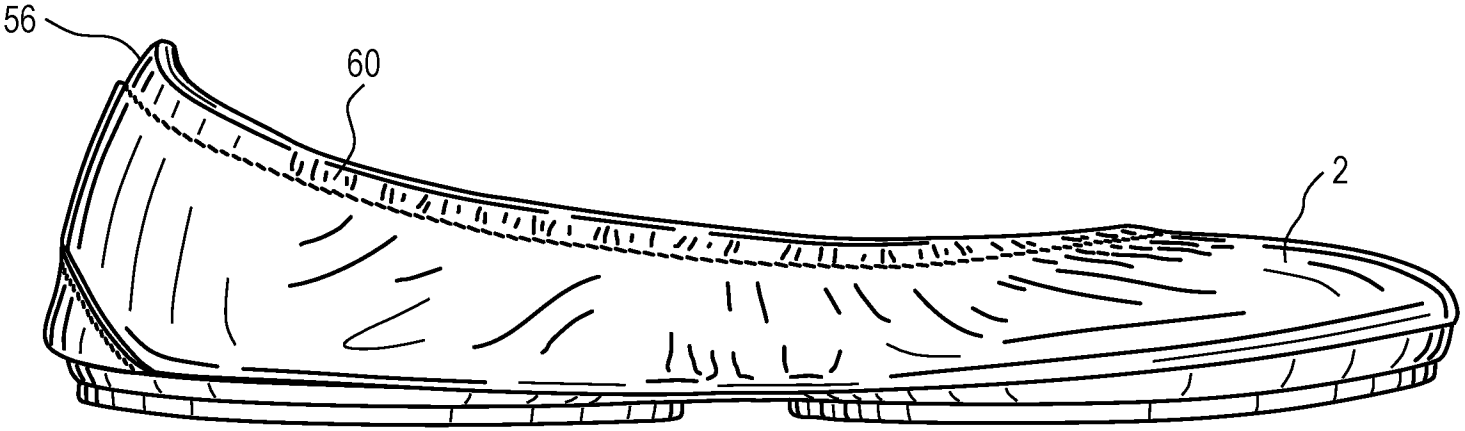
FIG. 2 is a side view of a shoe in accordance with an aspect of the disclosure in which the shoe is in an extended state.

In some embodiments, advantageously, the heel outsole patch 24 and the toe outsole patch 26 are each at least 3/32 of an inch thick. In some embodiments, advantageously, the heel outsole patch 24 and the toe outsole patch 26 are each at least 4/32 of an inch thick. In some embodiments, the heel outsole patch 24 and the toe outsole patch 26 are each at least 4/32 of an inch thick. In some embodiments, the heel outsole patch 24 and the toe outsole patch 26 are each at least 6/32 of an inch thick. In some embodiments, the heel outsole patch 24 and the toe outsole patch 26 are each at least 7/32 of an inch thick. In some embodiments, the heel outsole patch 24 and the toe outsole patch 26 are each at least 8/32 of an inch thick. Such thickness increases the spring constant of the soles, leading to greater support for the foot and increased durability of the shoe. Referring to FIG. 1, because of the thickness of the outsole patches, and their proximity to the edge, it is possible to view a side of the outsole patch at least at a 45 degree angle 100 from the horizontal 102 when the shoe is worn on a woman's foot when the woman is standing upright with respect to the horizontal. In some embodiments, it is possible to view a side of the outsole patch at least at a 50 degree angle, at least a 55 degree angle, or at least a 60 degree angle 100 from the horizontal 102 when the shoe is worn on a woman's foot when the woman is standing upright with respect to the horizontal. This visibility of the outsole patches is described herein solely to set forth a description of the dimensions and shapes of the disclosed shoes.

In some embodiments, the heel outsole patch 24 and the toe outsole patch 26 are each made out of an elastomer. Exemplary elastomers that may be used include but are not limited to, for example, natural rubber, vulcanized natural rubber, a butadiene-styrene copolymer such as GR-S, neoprene, nitrile rubbers, butyl, polysulfide rubbers, ethylene-propylene rubbers, polyurethane rubbers, and silicone rubbers as described in *Marks' Standard Handbook for Mechanical Engineers,* 1987, Avallone and Baumeister, eds., McGraw-Hill, New York, pp. 6-161 through 1-163, which is hereby incorporated herein by reference. In some embodiments the midsole 8 is made out of leather.

Figure 6B:
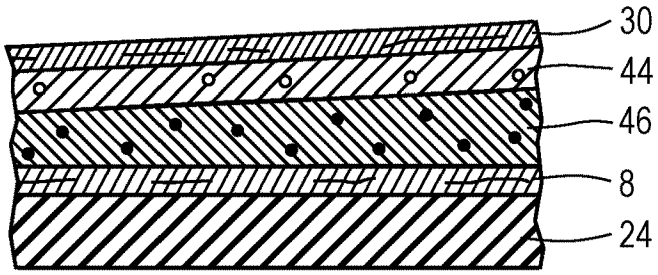
FIG. 6B is a cross-sectional view taken about region 6B-6B of FIG. 6.
Figure 6A:
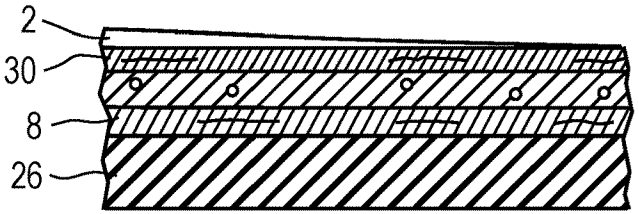
FIG. 6A is a cross-sectional view taken about region 6A-6A of FIG. 6.

Referring to FIGS. 6, 6A, and 6B, in some embodiments the shoe is characterized by a midsole 8. A heel outsole patch 24 and a toe outsole patch 26 are sewn onto a first face of the midsole 8. The midsole 8 comprises a second face having a heel portion 68 and a toe portion 70. In some embodiments, a cushion insert 46 is glued to the heel portion 68 of a second face of the midsole 8. The insert 46 absorbs impact to the foot when walking on hard surfaces. The insert 46 molds to the foot over time. A foam inlay 44 is glued to (i) the cushion insert 46 and (ii) the toe portion 70 of the second face of the midsole 8. Next an insole 30 is affixed by glue to the foam inlay 44. The cushion insert 46 is characterized by a first end 76 and a second end 78. The first end 76 of the cushion insert 46 is glued to a first part 72 of the heel portion 68 and the second end 78 of the cushion insert 46 is glued to a second part 74 of the heel portion 68. The first part 72 of the heel portion 68 is closer to the toe portion 70 of the second face of the midsole 8 than the second part 74 of the heel portion 68. In some embodiments, the first end 76 of the cushion insert 46 has a thickness that is less than the thickness of the second end 78 of the cushion insert 46. In some embodiments, the cushion insert 46 has a thickness that increases along the cushion insert 46 as a function of a distance away from the toe portion 70 of the second face of the midsole 8 so that a portion of the cushion insert that is closest to the toe portion 70 of the midsole is thinner than a portion of the cushion insert 46 that is farthest away from the toe portion 70 of the midsole 8. In some embodiments, the maximum thickness of the cushion insert 46 is 3 millimeters or more, 4 millimeters or more, 5 millimeters or more, 6 millimeters or more, 7 millimeters or more, or 8 millimeters or more. This advantageously serves to improve the support provided by the shoe, particularly at the heel, provides desired lift, and increases rigidity and thereby durability.

In addition to providing a graduated thickness to improve foot support, the cushion insert 46 is made out of a rigid material such as a rigid ethylene vinyl acetate or similar cushion material. In some embodiments, the cushion insert 46 has a Shore A hardness of between 45 and 70 or between 60 and 70. In some embodiments, the cushion insert 46 has a density of between 0.30 g/cm$^3$ and 0.5 g/cm$^3$, between 0.40 g/cm$^3$ and 0.5 g/cm$^3$, between 0.45 g/cm$^3$ and 0.5 g/cm$^3$, or between 0.50 g/cm$^3$ and 0.70 g/cm$^3$.

The thickness of the heel outsole patch 24 and the toe outsole patch 26 together with the materials used to make these patches, the proximity of these patches to the seam 22 and the ability to add the cushion insert, contributes to a greatly improved spring constant relative to known foldable shoes. In some embodiments, the overall spring constant of the shoe taken lengthwise in the heel portion 68 of the shoe (i.e., in the region of the heel outsole patch 24) is between 0.40 kilogram-force/inch and 0.70 kilogram-force/inch. In some embodiments, the overall spring constant of the shoe taken lengthwise in the heel portion 68 of the shoe is between 0.45 kilogram-force/inch and 0.65 kilogram-force/inch, or between 0.55 kilogram-force/inch and 0.65 kilogram-force/inch. In some embodiments, the overall spring constant of the shoe taken lengthwise in the heel portion 68 of the shoe is about 0.6 kilogram-force/inch. Referring to FIG. 6, to arrive at the spring constant measurement, the portions 68 and 70 are measured separately. For each region, with the shoe held in an upright position one end (i.e., one end of portion 68 or 70 going the long way and with shoe facing up as it would be worn) is anchored and then the other end of the portion 68 or 70 of the shoe being measured is forced down a set distance (e.g., 1 inch) and the force exerted by the pushed down end is then measured.

In some embodiments, the overall spring constant of the shoe taken lengthwise in the toe portion 70 of the shoe (i.e., in the region of the toe outsole patch 26) is between 0.40 kilogram-force/inch and 0.70 kilogram-force/inch. In some embodiments, the overall spring constant of the shoe taken lengthwise in the toe portion 70 of the shoe is between 0.45 kilogram-force/inch and 0.65 kilogram-force/inch or between 0.55 kilogram-force/inch and 0.65 kilogram-force/inch. In some embodiments, the overall spring constant of the shoe taken lengthwise in the toe portion 68 of the shoe is about 0.6 kilogram-force/inch.

Another advantageous feature of the shoes in accordance with some embodiments of the present disclosure are deep grooves in the heel outsole patch 24 and the toe outsole patch 26 that facilitate the stitching of the patches to the midsole 8 while at the same time protecting the stitching. The deep grooves 48 are enabled by the advantageous design in which thick outsole patches are employed that, at the same time, are proximate to the first seam 22 which attaches the upper 2 to the midsole 8. The deep grooves 48 protect the stitching that attaches the outsole patches to the midsole 9 from contact with the ground, which would cause the stitching to wear and thereby cause the outsole patches to become detached. These advantageous features are related. By only stitching the upper 2 to the midsole 8 to form the first seam, rather than further stitching insole 30 to the midsole 8, it is possible to both minimize distance 104 and increase thickness of the outsole patches 24/26 while still being able to stitch the midsole 8 to the upper 2 using conventional processes such as a sewing machine. Because distance 104 is minimized, it is possible to make the outsole patches 24/26 thicker (i.e., increase distance 106) without destabilizing foot support. Because the outsole patches 24/26 are thicker, it is possible to make the first groove 48 deeper thereby better protecting the stitching within the groove. Moreover, because the outsole patches are thicker, the shoe is firm and allows for use for longer periods of time and a greater spectrum of terrain (e.g., on asphalt, concrete, dirt roads, etc.) Referring to FIG. 9, one such advantageous embodiment has a first groove 48 having a depth of at least 3/64 of an inch that is formed proximate to a perimeter of the heel outsole patch 24. The heel outsole patch 24 is stitched onto the heel portion of the first face of the midsole 8 with a first thread that occupies the first groove 48. Further, a second groove 50 having a depth of at least 3/64 of an inch is formed proximate to a perimeter of the toe outsole patch 26. The toe outsole patch 26 is stitched onto the toe portion of the first face of the midsole 8 with a second thread that occupies the second groove 50. In some embodiments, the first groove 48 is about 3/32 of an inch. In some embodiments, the second groove 50 is about 3/32 of an inch.

Figure 5:
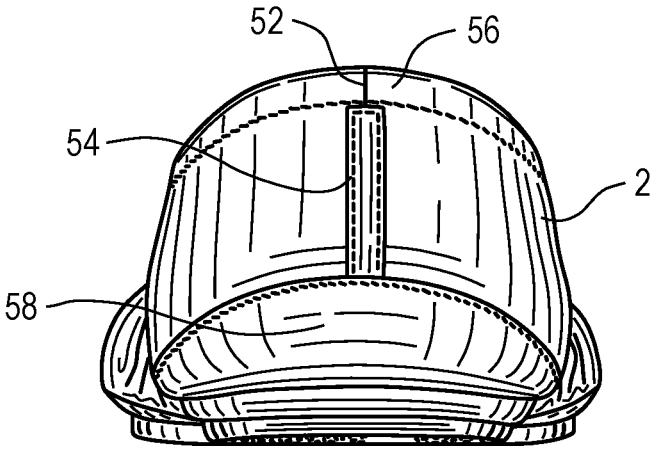
FIG. 5 is a rear view of a shoe in accordance with an aspect of the disclosure in which the shoe is in an extended state.

Referring to FIG. 5, the upper 2 is formed as a single piece having a first end and a second end, where the first end and the second end are united by a second seam 52 at the heel cavity. In some embodiments upper 2 is formed of two or more pieces.

Figure 3:
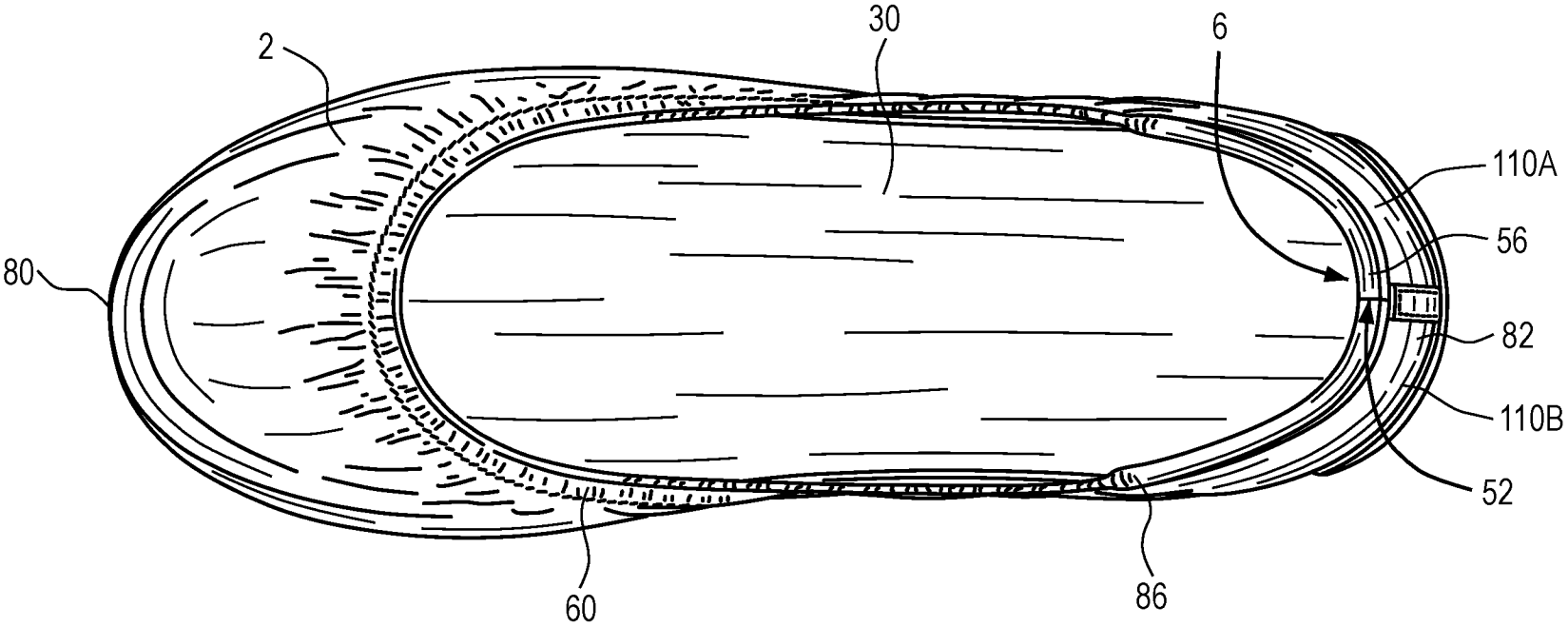
FIG. 3 is a top view of a shoe in accordance with an aspect of the disclosure in which the shoe is in an extended state.
Figure 4:
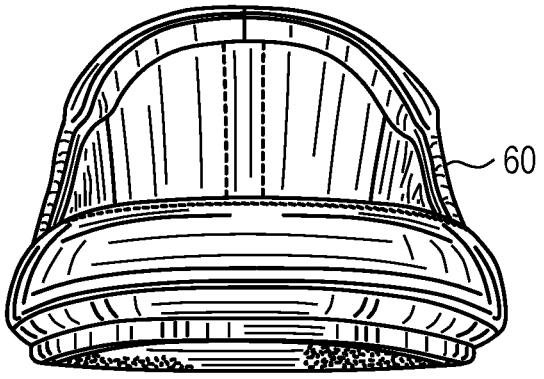
FIG. 4 is a front view of a shoe in accordance with an aspect of the disclosure in which the shoe is in an extended state.

Referring to FIGS. 3 and 9, in typical embodiments, the upper 2 is formed as a single piece having (i) a first end (80), (ii) a second end (82), (iii) a first edge (84) (visible in FIG. 9), and (iv) a second edge (86). In some embodiments, upper 2 is formed of two or more pieces sewn together. Referring to FIG. 3, in typical embodiments, upper 2 is a single piece having ends 110A and 110B. Of course, upper 2 may be formed by any number of pieces sewn together into a single piece having ends 110A and 110B. Regardless of whether upper originates as one or multiple pieces, ends 110A (first end) and 110B (second end) are united by a second seam 52 at the heel cavity 6 to complete the upper 2. Referring to FIG. 9, the first edge 84 of the upper 2 is stitched to the perimeter of the midsole 8 thereby forming the second seam 22 and the bottom to the interior portion of the shoe. Referring back to FIG. 3, a first portion of the second edge 86 is characterized by an elastic restriction 60, where the portion of the second edge does not extend to the heel cavity 6. In some embodiments, the second portion of the second edge 86 is characterized by an Achilles cushion 56 that provides an upper boundary to the heel cavity 6. Further, referring to FIG. 5, in some embodiments, a half-moon piece 58 covers a lower portion of the second seam 52 whereas a strip portion 54 covers an upper portion of the second seam 52.

Referring to FIG. 11, in some embodiments, the shoe is in a folded state. In this folded state, the shoes can be tucked into a stretch nylon or similar material compacting pouch (FIG. 12), having a drawstring. This provides for the advantageous transport of the shoes in a clean and compact state, while compressed into a minimal size. In some embodiments, the pouch includes a pocket for holding a tote bag, where the tote bag is configured to accommodate a pair of women's shoes, or other items and personal effects. This allows for the possibility of carrying the shoes of the present disclosure in the pouch, while on the road, and switching to wearing the shoes of the present disclosure by storing unwanted previously worn shoes in the tote bag after it has been removed from the pocket of the pouch, and expanded from its collapsed form.

Figure 10:
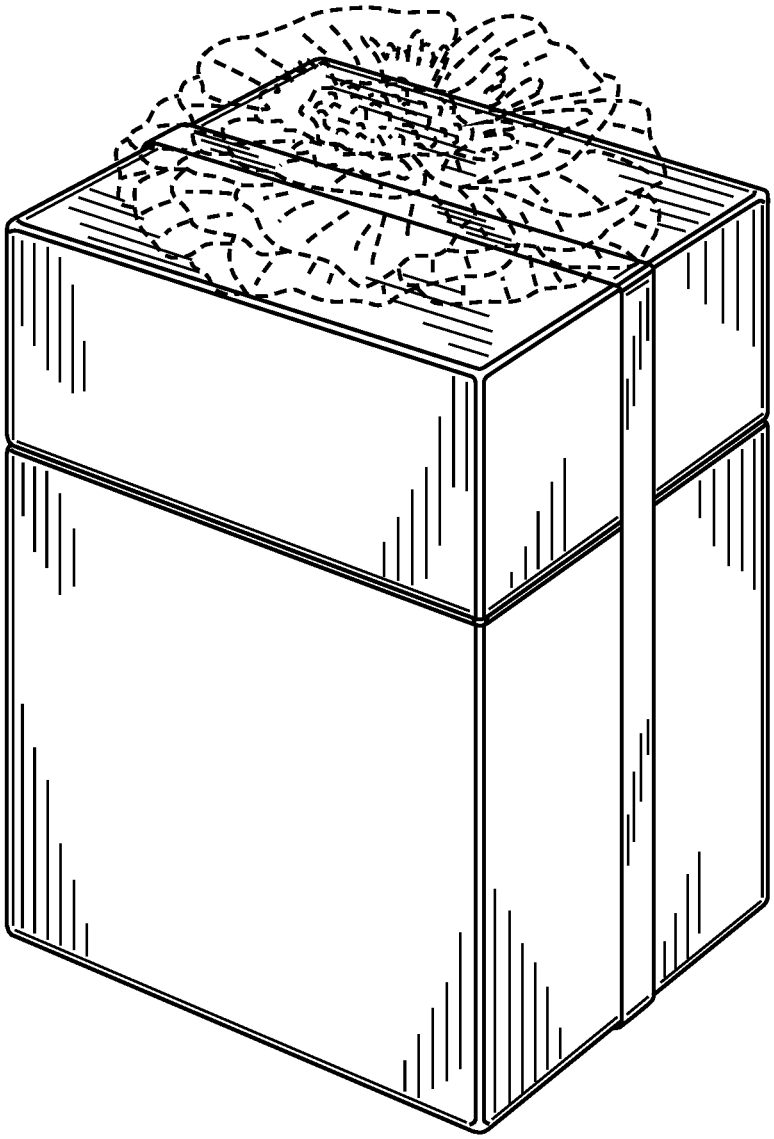
FIG. 10 is a compact box having a lid in which a pair of shoes of the instant disclosure can be stored in the folded state.

Advantageously, the shoes of the present disclosure tuck into a folded state so that they may be stored in a compact box having a lid. Such a compact box is illustrated in FIG. 10.

EXEMPLARY EMBODIMENTS

The following are nonlimiting exemplary embodiments of the present disclosure.

Embodiment A. A shoe comprising:

an upper, the upper forming an interior portion for receiving a foot of a person, the interior portion including a toe cavity and a heel cavity;

a midsole, the midsole having (i) a toe end, (ii) a heel end, (iii) an inner side, and (iv) an outer side, wherein a perimeter of the midsole is stitched to the upper thereby forming a bottom to the interior portion that is bounded by a first seam;

a heel outsole patch stitched onto a heel portion of a first face of the midsole;

a toe outsole patch stitched onto a toe portion of the first face of the midsole;

an insole that is affixed by glue to the bottom of the interior portion;

wherein there is a spacing between (i) the heel outsole patch stitched onto the heel portion of the first face of the midsole and (ii) the toe outsole patch stitched onto the toe portion of the first face of the midsole, the spacing extending from the inner side to the outer side and occupying a position intermediate the toe end and the heel end thereby permitting the entire shoe to fold about an axis in the spacing running between the inner side and the outer side;

wherein the shoe is configured to fold between (i) an extended state wherein the heel outsole patch and the toe outsole patch are coplanar and (ii) a folded state in which the shoe is bent about the axis such that a portion of the upper comprising the toe cavity is tucked into the heel cavity, and wherein (i) the insole is not stitched to the upper or midsole, and (ii) the heel outsole patch and the toe outsole patch are each made out of an elastomer.

Embodiment B. A shoe comprising:

an upper, the upper forming an interior portion for receiving a foot of a person, the interior portion including a toe cavity and a heel cavity;

a midsole, the midsole having (i) a toe end, (ii) a heel end, (iii) an inner side, and (iv) an outer side, wherein a perimeter of the midsole is stitched to the upper thereby forming a bottom to the interior portion that is bounded by a first seam;

a heel outsole patch stitched onto a heel portion of a first face of the midsole;

a toe outsole patch stitched onto a toe portion of the first face of the midsole;

an insole that is affixed by glue to the bottom of the interior portion;

wherein there is a spacing between (i) the heel outsole patch stitched onto the heel portion of the first face of the midsole and (ii) the toe outsole patch stitched onto the toe portion of the first face of the midsole, the spacing extending from the inner side to the outer side and occupying a position intermediate the toe end and the heel end thereby permitting the entire shoe to fold about an axis in the spacing running between the inner side and the outer side;

wherein the shoe is configured to fold between (i) an extended state wherein the heel outsole patch and the toe outsole patch are coplanar and (ii) a folded state in which the shoe is bent about the axis such that a portion of the upper comprising the toe cavity is tucked into the heel cavity, and wherein (i) the insole is not stitched to the upper, and (ii) a region of the shoe defined by the heel outsole patch and comprising a corresponding portion of the midsole and the insole has a spring constant of between 0.40 kilogram-force/inch and 0.70 kilogram-force/inch.

Embodiment C. A shoe comprising:

an upper, the upper forming an interior portion for receiving a foot of a person, the interior portion including a toe cavity and a heel cavity;

a midsole, the midsole having (i) a toe end, (ii) a heel end, (iii) an inner side, and (iv) an outer side, wherein a perimeter of the midsole is stitched to the upper thereby forming a bottom to the interior portion that is bounded by a first seam;

a heel outsole patch stitched onto a heel portion of a first face of the midsole;

a toe outsole patch stitched onto a toe portion of the first face of the midsole;

an insole that is affixed by glue to the bottom of the interior portion;

wherein there is a spacing between (i) the heel outsole patch stitched onto the heel portion of the first face of the midsole and (ii) the toe outsole patch stitched onto the toe portion of the first face of the midsole, the spacing extending from the inner side to the outer side and occupying a position intermediate the toe end and the heel end thereby permitting the entire shoe to fold about an axis in the spacing running between the inner side and the outer side;

wherein the shoe is configured to fold between (i) an extended state wherein the heel outsole patch and the toe outsole patch are coplanar and (ii) a folded state in which the shoe is bent about the axis such that a portion of the upper comprising the toe cavity is tucked into the heel cavity, and wherein (i) the insole is not stitched to the upper, and (ii) a back corner of the toe outsole patch is within ¼ of an inch of a portion of the first seam.

Embodiment D. A shoe comprising:

an upper, the upper forming an interior portion for receiving a foot of a person, the interior portion including a toe cavity and a heel cavity;

a midsole, the midsole having (i) a toe end, (ii) a heel end, (iii) an inner side, and (iv) an outer side, wherein a perimeter of the midsole is stitched to the upper thereby forming a bottom to the interior portion that is bounded by a first seam;

a heel outsole patch stitched onto a heel portion of a first face of the midsole;

a toe outsole patch stitched onto a toe portion of the first face of the midsole;

an insole that is affixed by glue to the bottom of the interior portion;

wherein there is a spacing between (i) the heel outsole patch stitched onto the heel portion of the first face of the midsole and (ii) the toe outsole patch stitched onto the toe portion of the first face of the midsole, the spacing extending from the inner side to the outer side and occupying a position intermediate the toe end and the heel end thereby permitting the entire shoe to fold about an axis in the spacing running between the inner side and the outer side;

wherein the shoe is configured to fold between (i) an extended state wherein the heel outsole patch and the toe outsole patch are coplanar and (ii) a folded state in which the shoe is bent about the axis such that a portion of the upper comprising the toe cavity is tucked into the heel cavity, and wherein (i) the insole is not stitched to the upper, (ii) a first groove having a depth of at least 3/64 of an inch is formed proximate to a perimeter of the heel outsole patch and wherein the heel outsole patch is stitched onto the heel portion of the first face of the midsole with a first thread that occupies the first groove; and (iii) a second groove having a depth of at least 3/64 of an inch is formed proximate to a perimeter of the toe outsole patch and wherein the toe outsole patch is stitched onto the toe portion of the first face of the midsole with a second thread that occupies the second groove.

Embodiment E. A shoe comprising:

an upper, the upper forming an interior portion for receiving a foot of a person, the interior portion including a toe cavity and a heel cavity;

a midsole, the midsole having (i) a toe end, (ii) a heel end, (iii) an inner side, and (iv) an outer side, wherein a perimeter of the midsole is stitched to the upper thereby forming a bottom to the interior portion that is bounded by a first seam;

a heel outsole patch stitched onto a heel portion of a first face of the midsole;

a toe outsole patch stitched onto a toe portion of the first face of the midsole;

an insole that is affixed by glue to the bottom of the interior portion;

wherein there is a spacing between (i) the heel outsole patch stitched onto the heel portion of the first face of the midsole and (ii) the toe outsole patch stitched onto the toe portion of the first face of the midsole, the spacing extending from the inner side to the outer side and occupying a position intermediate the toe end and the heel end thereby permitting the entire shoe to fold about an axis in the spacing running between the inner side and the outer side;

wherein the shoe is configured to fold between (i) an extended state wherein the heel outsole patch and the toe outsole patch are coplanar and (ii) a folded state in which the shoe is bent about the axis such that a portion of the upper comprising the toe cavity is tucked into the heel cavity, and wherein (i) a region of the shoe defined by the heel outsole patch and comprising a corresponding portion of the midsole and the insole has a spring constant of between 0.45 kilogram-force/inch and 0.55 kilogram-force/inch; and (ii) the toe outsole patch or the heel outsole patch has a durability coefficient of between 0.8 and 1.5.

Embodiment F. A method of manufacturing a shoe, the method comprising:

(A) stitching a heel outsole patch onto a heel portion of a first face of a midsole;

(B) stitching a toe outsole patch onto a toe portion of the first face of the midsole;

(C) affixing a cushion insert to the heel portion of a second face of the midsole, (D) sewing an upper, the upper forming an interior portion for receiving a foot of a person, the interior portion including a toe cavity and a heel cavity, to the midsole, the midsole having (i) a toe end, (ii) a heel end, (iii) an inner side, and (iv) an outer side, wherein the sewing (D) results in a perimeter of the midsole being stitched to the upper thereby forming a bottom to the interior portion that is bounded by a first seam;

(E) affixing by glue an insole to the bottom of the interior portion;

wherein, the stitching (A) and stitching (B) form a spacing between (i) the heel outsole patch stitched onto the heel portion of the first face of the midsole and (ii) the toe outsole patch stitched onto the toe portion of the first face of the midsole, the spacing extending from the inner side to the outer side and occupying a position intermediate the toe end and the heel end thereby permitting the entire shoe to fold about an axis in the spacing running between the inner side and the outer side;

wherein the shoe is configured to fold between (i) an extended state wherein the heel outsole patch and the toe outsole patch are coplanar and (ii) a folded state in which the shoe is bent about the axis such that a portion of the upper comprising the toe cavity is tucked into the heel cavity, and wherein (i) the insole is not stitched to the upper or midsole, and (ii) the heel outsole patch and the toe outsole patch are each made out of an elastomer.

Embodiment G. A method of manufacturing a shoe, the method comprising:

(A) stitching a heel outsole patch onto a heel portion of a first face of a midsole;

(B) stitching a toe outsole patch onto a toe portion of the first face of the midsole;

(C) sewing an upper, the upper forming an interior portion for receiving a foot of a person, the interior portion including a toe cavity and a heel cavity, to the midsole, the midsole having (i) a toe end, (ii) a heel end, (iii) an inner side, and (iv) an outer side, wherein the sewing (C) results in a perimeter of the midsole being stitched to the upper thereby forming a bottom to the interior portion that is bounded by a first seam;

(D) affixing by glue an insole to the bottom of the interior portion;

wherein, the stitching (A) and stitching (B) form a spacing between (i) the heel outsole patch stitched onto the heel portion of the first face of the midsole and (ii) the toe outsole patch stitched onto the toe portion of the first face of the midsole, the spacing extending from the inner side to the outer side and occupying a position intermediate the toe end and the heel end thereby permitting the entire shoe to fold about an axis in the spacing running between the inner side and the outer side;

wherein the shoe is configured to fold between (i) an extended state wherein the heel outsole patch and the toe outsole patch are coplanar and (ii) a folded state in which the shoe is bent about the axis such that a portion of the upper comprising the toe cavity is tucked into the heel cavity, and wherein (i) a region of the shoe defined by the heel outsole patch and comprising a corresponding portion of the midsole and the insole has a spring constant of between 0.45 kilogram-force/inch and 0.55 kilogram-force/inch; and (ii) the toe outsole patch or the heel outsole patch has a durability coefficient of between 0.8 and 1.5.

Embodiment H-1. Any one of embodiments A, B, C, D, E, F and G, wherein the midsole is made out of leather.

Embodiment H-2. Any one of embodiments A, B, C, D, E, F and G, wherein the bottom of the interior portion further comprises a foam inlay and wherein the insole is affixed by glue to the foam inlay.

Embodiment H-3. Any one of embodiments A, B, C, D, E, F and G, wherein the interior portion further comprises a cushion insert that is glued to the heel portion of a second face of the midsole.

Embodiment H-4. The embodiment of H-2, wherein the midsole comprises a second face having a heel portion and a toe portion and wherein the interior portion further comprises a cushion insert that is glued to the heel portion of a second face of the midsole, and the foam inlay is glued to (i) cushion insert and (ii) the toe portion of the second face of the midsole.

Embodiment H-5. The embodiment of H-3, wherein the cushion insert is characterized by a first end and a second end, wherein the first end of the cushion insert is glued to a first part of the heel portion and the second end of the cushion insert is glued to a second part of the heel portion, wherein the first part of the heel portion is closer to the toe portion of the second face of the midsole than the second part of the heel portion, and the first end of the cushion insert has a thickness that is less than the second end of the cushion insert.

Embodiment H-6. The embodiment of H-3, wherein the cushion insert has a thickness that increases along the insert as a function of a distance away from the toe portion of the second face of the midsole so that a portion of the cushion insert that is closest to the toe portion of the midsole is thinner than a portion of the cushion insert that is farthest away from the toe portion of the midsole.

Embodiment H-7. The embodiment of H-3, wherein the cushion insert comprises a ethylene vinyl acetate or polyurethane type material.

Embodiment H-8. The embodiment of H-3, the cushion insert has a Shore A hardness of between 45 and 70 or between 60 and 70.

Embodiment H-9. The embodiment of H-3, wherein the cushion insert has a density of between 0.30 g/cm$^3$ and 0.7 g/cm$^3$.

Embodiment H-10. The embodiment of H-3, wherein the cushion insert has a density of between 0.40 g/cm$^3$ and 0.7 g/cm$^3$.

Embodiment H-11. Any one of embodiments A, B, C, D, E, F and G, wherein a first groove having a depth of at least 3/64 of an inch is formed proximate to a perimeter of the heel outsole patch and wherein the heel outsole patch is stitched onto the heel portion of the first face of the midsole with a first thread that occupies the first groove; and a second groove having a depth of at least 3/64 of an inch is formed proximate to a perimeter of the toe outsole patch and wherein the toe outsole patch is stitched onto the toe portion of the first face of the midsole with a second thread that occupies the second groove.

Embodiment H-12. Any one of embodiments A, B, C, D, E, F and G, wherein the upper is formed as a single piece having a first end and a second end, wherein the first end and the second end are united by a second seam at the heel cavity.

Embodiment H-13. Any one of embodiments A, B, C, D, E, F and G, wherein the upper is formed as a single piece having (i) a first end, (ii) a second end, (iii) a first edge, and (iv) a second edge, the first end and the second end are united by a second seam at the heel cavity, the first edge is stitched to the perimeter of the midsole thereby forming the bottom to the interior portion, a first portion of the second edge is characterized by an elastic restriction, wherein the portion of the second edge does not extend to the heel cavity.

Embodiment H-14. Any one of embodiments A, B, C, D, E, F and G, wherein a second portion of the second edge is characterized by an Achilles cushion that provides an upper boundary to the heel cavity.

Embodiment H-15. Any one of embodiments A, B, C, D, E, F and G, wherein the upper is formed as a single piece having a first end and a second end, the first end and the second end are united by a second seam at the heel cavity, and a half moon piece covers a lower portion of the second seam.

Embodiment H-16. Any one of embodiments A, B, C, D, E, F and G, wherein the shoe is in a folded state and is tucked into a pouch having a drawstring.

Embodiment H-17. The embodiment of H-16, wherein the pouch includes a pocket for holding a tote bag, wherein the tote bag is configured to accommodate a pair of shoes.

Embodiment H-18. Any one of embodiments A, B, C, D, E, F and G, wherein the shoe is in a folded state and is tucked into a compact box having a lid.

Embodiment H-19. Any one of embodiments A, B, C, D, E, F and G, wherein a back corner of the toe outsole patch is within 1/4 of an inch of a portion of the first seam.

Embodiment H-20. Any one of embodiments A, B, C, D, E, F and G, wherein a back corner of the toe outsole patch is within 3/16 of an inch of a portion of the first seam.

Embodiment H-21. Any one of embodiments A, B, C, D, E, F and G, wherein a front corner of the toe outsole patch is within 1/4 of an inch of a portion of the first seam.

Embodiment H-22. Any one of embodiments A, B, C, D, E, F and G, wherein a back corner of the heel outsole patch is within 3/16 of an inch of a portion of the first seam.

Embodiment H-23. Any one of embodiments A, B, C, D, E, F and G, wherein a back corner of the heel outsole patch is within 1/4 of an inch of a portion of the first seam.

Embodiment H-24. Any one of embodiments A, B, C, D, E, F and G, wherein the toe outsole patch or the heel outsole patch has a durability coefficient of between 0.8 and 1.5.

Embodiment H-25. Any one of embodiments A, B, C, D, E, F and G, wherein the toe outsole patch or the heel outsole patch has a durability coefficient of between 1.0 and 1.3.

Embodiment H-26. Any one of embodiments A, B, C, D, E, F and G, wherein the heel outsole patch and the toe outsole patch are each at least 3/32 of an inch thick.

Embodiment H-27. Any one of embodiments A, B, C, D, E, F and G, wherein the heel outsole patch and the toe outsole patch are each about 5/32 of an inch thick.

Embodiment H-28. Any one of embodiments A, B, C, D, E, F and G, wherein the spacing is between 4/8 of an inch and 6/8 of an inch.

Embodiment H-29. Any one of embodiments A, B, C, D, E, F and G, wherein the spacing is about 5/8 of an inch.

Embodiment H-30. Any one of embodiments A, B, C, D, E, F and G, wherein a side of the heel outsole patch is visible at least at a 45 degree angle from the horizontal when the shoe is worn on a person's foot who is standing on the horizontal.

Embodiment H-31. Any one of embodiments A, B, C, D, E, F and G, wherein a side of the toe outsole patch is visible at least at a 45 degree angle from the horizontal when the shoe is worn on a person's foot who is standing on the horizontal.

Embodiment H-32. Any one of embodiments A, B, C, D, E, F and G, wherein a region of the shoe defined by the heel outsole patch and comprising a corresponding portion of the midsole and the insole has a spring constant of between 0.40 kilogram-force/inch and 0.70 kilogram-force/inch.

Embodiment H-33. Any one of embodiments A, B, C, D, E, F and G, wherein a region of the shoe defined by the heel outsole patch and comprising a corresponding portion of the midsole and the insole has a spring constant of between 0.45 kilogram-force/inch and 0.55 kilogram-force/inch.

Embodiment H-34. Any one of embodiments A, B, C, D, E, F and G, wherein a region of the shoe defined by the toe outsole patch and comprising a corresponding portion of the midsole and the insole has a spring constant of between 0.40 kilogram-force/inch and 0.70 kilogram-force/inch.

Embodiment H-35. Any one of embodiments A, B, C, D, E, F and G, wherein a region of the shoe defined by the toe outsole patch and comprising a corresponding portion of the midsole and the insole has a spring constant of between 0.45 kilogram-force/inch and 0.55 kilogram-force/inch.

Embodiment H-36. Any one of embodiments A, B, C, D, E, F and G, wherein the shoe is a shoe for women.

Embodiment H-37. Any one of embodiments A, B, C, D, E, F and G, wherein the shoe is a shoe for men.

Embodiment H-38. Any one of embodiments A, B, C, D, E, F and G, wherein the shoe is a shoe for men, women, or children.

REFERENCES CITED AND ALTERNATIVE EMBODIMENTS

All references cited herein are incorporated herein by reference in their entirety and for all purposes to the same extent as if each individual publication or patent or patent application was specifically and individually indicated to be incorporated by reference in its entirety for all purposes.

Many modifications and variations of this invention can be made without departing from its spirit and scope, as will be apparent to those skilled in the art. The specific embodiments described herein are offered by way of example only. The embodiments were chosen and described in order to best explain the principles of the invention and its practical applications, to thereby enable others skilled in the art to best utilize the invention and various embodiments with various modifications as are suited to the particular use contemplated.

This disclosure extends to various footwear styles (in addition to the basic ballet flat/slipper depicted in the diagrams). For example: sandals, flip-flops, active and athletic shoes can be made with a similar construction for flexible compression and compact storage and are fully encompassed within the scope of the present invention. Moreover, while embodiments have been disclosed that are designed for woman, it will be appreciated that such shoes can be designed for men, children, or any combination of woman, men, and children. All such alternative designs are fully within the scope of the present disclosure.

The core shoe design and compacting pouch described offer significant potential for superficial differentiation via ornamentation, materials, and colors, increasing their commercial appeal. Alternative construction methods may include gluing of the outsoles to the midsole without any stitching. The invention is to be limited only by the terms of the appended claims, along with the full scope of equivalents to which such claims are entitled.

What is claimed:

1. A shoe comprising:

an upper, the upper forming an interior portion for receiving a foot of a woman, the interior portion including a toe cavity and a heel cavity;

a midsole, the midsole having (i) a toe end, (ii) a heel end, (iii) an inner side, and (iv) an outer side, wherein a perimeter of the midsole is stitched to the upper thereby forming a bottom to the interior portion that is bounded by a first seam;

an insole that is affixed to the bottom of the interior portion;

an outsole, the outsole having (i) a toe portion disposed on the toe end of the midsole, and (ii) a heel portion disposed on the heel end of the midsole;

wherein there is a region between (i) the heel portion of the outsole and (ii) the toe portion of the outsole, the region extending from the inner side to the outer side and occupying a position intermediate the toe end of the midsole and the heel end of the midsole, thereby permitting the shoe to fold about the region;

the heel portion of the outsole has a durability coefficient between 0.8 and 1.5, wherein the durability coefficient is a thickness of the heel portion of the outsole divided by a distance between an edge of the heel portion of the outsole and the first seam.

2. The shoe of claim 1, wherein the insole is affixed by glue to the bottom of the interior portion.

3. The shoe of claim 1, wherein the midsole is stitched to the upper thereby forming the bottom to the interior portion that is bounded by a first seam.

4. The shoe of claim 3, wherein a back edge of the toe portion of the outsole is within 1/4 of an inch of a portion of the first seam.

5. The shoe of claim 3, wherein a back edge of the toe portion of the outsole is within 3/16 of an inch of a portion of the first seam.

6. The shoe of claim 3, wherein a front edge of the toe portion of the outsole is within 1/4 of an inch of a portion of the first seam.

7. The shoe of claim 3, wherein a back edge of the heel portion of the outsole is within 3/16 of an inch of a portion of the first seam.

8. The shoe of claim 3, wherein a back edge of the heel portion of the outsole is within 1/4 of an inch of a portion of the first seam.

9. The shoe of claim 1, wherein the outsole is stitched onto a first face of the midsole.

10. The shoe of claim 1, wherein a portion of the shoe defined by the heel portion of the outsole and comprising a corresponding portion of the midsole and the insole has a spring constant of between 0.45 kilogram-force/inch and 0.55 kilogram-force/inch.

11. The shoe of claim 1, wherein the durability coefficient is between 0.9 and 1.4.

12. The shoe of claim 1, wherein the durability coefficient is between 1.0 and 1.3.

13. The shoe of claim 1, wherein a first groove having a depth of at least 3/64 of an inch is formed proximate to an edge of the heel portion of the outsole and wherein the heel portion of the outsole is stitched to the midsole with a first thread that occupies the first groove; and a second groove having a depth of at least 3/64 of an inch is formed proximate to an edge of the toe portion of the outsole and wherein the toe portion of the outsole is stitched to the midsole with a second thread that occupies the second groove.

14. A shoe comprising:

an upper, the upper forming an interior portion for receiving a foot of a woman, the interior portion including a toe cavity and a heel cavity;

a midsole, the midsole having (i) a toe end, (ii) a heel end, (iii) an inner side, and (iv) an outer side, wherein a perimeter of the midsole is stitched to the upper thereby forming a bottom to the interior portion that is bounded by a first seam;

an outsole, the outsole having (i) a toe portion disposed on the toe end of the midsole, and (ii) a heel portion disposed on the heel end of the midsole;

an insole that is affixed to the bottom of the interior portion;

wherein there is a region between (i) the heel portion of the outsole and (ii) the toe portion of the outsole, the region extending from the inner side to the outer side and occupying a position intermediate the toe end of the midsole and the heel end of the midsole, thereby permitting the shoe to fold about the region;

the heel portion of the outsole has a first durability coefficient that is between 0.8 and 1.5, wherein the first durability coefficient is a thickness of the heel portion of the outsole divided by a distance between an edge of the heel portion of the outsole and the first seam; and the toe portion of the outsole has a second durability coefficient that is between 0.8 and 1.5, wherein the second durability coefficient is a thickness of the toe portion of the outsole divided by a distance between an edge of the toe portion of the outsole and the first seam.

15. The shoe of claim 14, wherein a back edge of the heel portion of the outsole is within 3/16 of an inch of a portion of the first seam.

16. The shoe of claim 14, wherein a back edge of the heel portion of the outsole is within 1/4 of an inch of a portion of the first seam.

17. The shoe of claim 14, wherein the first durability coefficient is between 0.9 and 1.4, and the second durability coefficient is between 0.9 and 1.4.

18. The shoe of claim 14, wherein the first durability coefficient is between 1.0 and 1.3, and the second durability coefficient is between 1.0 and 1.3.

19. The shoe of claim 14, wherein a first groove having a depth of at least 3/64 of an inch is formed proximate to an edge of the heel portion of the outsole and wherein the heel portion of the outsole is stitched to the midsole with a first thread that occupies the first groove; and a second groove having a depth of at least 3/64 of an inch is formed proximate to an edge of the toe portion of the outsole and wherein the toe portion of the outsole is stitched to the midsole with a second thread that occupies the second groove.

* * * * *